US007048050B2

(12) United States Patent
Vail, III et al.

(10) Patent No.: US 7,048,050 B2
(45) Date of Patent: May 23, 2006

(54) METHOD AND APPARATUS FOR CEMENTING DRILL STRINGS IN PLACE FOR ONE PASS DRILLING AND COMPLETION OF OIL AND GAS WELLS

(75) Inventors: William Banning Vail, III, Bothell, WA (US); James E. Chitwood, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 71 days.

(21) Appl. No.: 10/678,731

(22) Filed: Oct. 2, 2003

(65) Prior Publication Data

US 2004/0112646 A1 Jun. 17, 2004

Related U.S. Application Data

(63) Continuation of application No. 10/162,302, filed on Jun. 4, 2002, now Pat. No. 6,868,906, which is a continuation-in-part of application No. 09/487,197, filed on Jan. 19, 2000, now Pat. No. 6,397,946, which is a continuation-in-part of application No. 09/295,808, filed on Apr. 20, 1999, now Pat. No. 6,263,987, which is a continuation-in-part of application No. 08/708,396, filed on Sep. 3, 1996, now Pat. No. 5,894,897, which is a continuation-in-part of application No. 08/323,152, filed on Oct. 14, 1994, now Pat. No. 5,551,521.

(60) Provisional application No. 60/313,654, filed on Aug. 19, 2001, provisional application No. 60/353,457, filed on Jan. 31, 2002, provisional application No. 60/367,638, filed on Mar. 26, 2002, and provisional application No. 60/384,964, filed on Jun. 3, 2002.

(51) Int. Cl.
*E21B 44/06* (2006.01)
*E21B 43/00* (2006.01)

(52) U.S. Cl. ..... 166/250.01; 166/250.15; 166/65.1; 166/66.7; 340/853.3

(58) Field of Classification Search ..... 175/257, 175/318, 171, 202; 166/250.01, 250.15, 65.1, 166/66.7

See application file for complete search history.

(56) References Cited

U.S. PATENT DOCUMENTS 761,518 A 5/1904 Lykken
988,504 A 4/1911 Wiet (Continued)

FOREIGN PATENT DOCUMENTS

DE 3 213 464 10/1983
DE 4 133 802 10/1992

(Continued)

OTHER PUBLICATIONS

Rotary Drilling, The Drill Stem, Unit I, Lesson 3, Second Edition, The University of Texas at Austin, Austin, Texas.

(Continued)

*Primary Examiner*—Frank S. Tsay
(74) *Attorney, Agent, or Firm*—Moser, Patterson & Sheridan, L.L.P.

(57) ABSTRACT

The steel drill string attached to a drilling bit during typical rotary drilling operations used to drill oil and gas wells is used for a second purpose as the casing that is cemented in place during typical oil and gas well completions. Methods of operation are described that provide for the efficient installation a cemented steel cased well wherein the drill string and the drill bit are cemented into place during one single drilling pass down into the earth. The normal mud passages or watercourses present in the rotary drill bit are used for the second independent purpose of passing cement into the annulus between the casing and the well while cementing the drill string into place during one single pass into the earth. A one-way cement valve is installed near the drill bit of the drill string that allows the cement to set up efficiently under ambiently hydrostatic conditions while the drill string and drill bit are cemented into place during one single drilling pass into the earth.

47 Claims, 1 Drawing Sheet

U.S. PATENT DOCUMENTS

| | | | | |
|---|---|---|---|---|
| 1,185,582 | A | 5/1916 | Bignall | |
| 1,301,285 | A | 4/1919 | Leonard | |
| 1,324,303 | A | 12/1919 | Carmichael | |
| 1,342,424 | A | 6/1920 | Cotten | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,842,638 | A | 1/1932 | Wigle | |
| 1,880,218 | A | 10/1932 | Simmons | |
| 1,917,135 | A | 7/1933 | Littell | |
| 1,930,825 | A | 10/1933 | Raymond | |
| 1,981,525 | A | 11/1934 | Price | |
| 2,017,451 | A | 10/1935 | Wickersham | |
| 2,049,450 | A | 8/1936 | Johnson | |
| 2,060,352 | A | 11/1936 | Stokes | |
| 2,214,226 | A | 9/1940 | English | |
| 2,214,429 | A | 9/1940 | Miller | 166/16 |
| 2,216,226 | A | 10/1940 | Bumpous | |
| 2,216,895 | A | 10/1940 | Stokes | |
| 2,295,803 | A | 9/1942 | O'Leary | |
| 2,324,679 | A | 7/1943 | Nellie | |
| 2,383,214 | A | 8/1945 | Prout et al. | |
| 2,424,878 | A | 7/1947 | Crook | |
| 2,499,630 | A | 3/1950 | Clark | |
| 2,519,116 | A | 8/1950 | Crake | |
| 2,522,444 | A | 9/1950 | Grable | 166/16 |
| 2,610,690 | A | 9/1952 | Beatty | 166/16 |
| 2,621,742 | A | 12/1952 | Brown | 166/1 |
| 2,627,891 | A | 2/1953 | Clark | |
| 2,633,374 | A | 3/1953 | Boice | |
| 2,641,444 | A | 6/1953 | Moon | |
| 2,650,314 | A | 8/1953 | Hennigh et al. | 310/67 |
| 2,663,073 | A | 12/1953 | Bieber et al. | |
| 2,668,689 | A | 2/1954 | Cormany | 255/35 |
| 2,692,059 | A | 10/1954 | Bolling, Jr. | 214/2.5 |
| 2,738,011 | A | 3/1956 | Mabry | 166/144 |
| 2,743,087 | A | 4/1956 | Layne et al. | |
| 2,743,495 | A | 5/1956 | Eklund | 22/202 |
| 2,764,329 | A | 9/1956 | Hampton | |
| 2,765,146 | A | 10/1956 | Williams, Jr. | |
| 2,797,893 | A | 7/1957 | McCune et al. | |
| 2,805,043 | A | 9/1957 | Williams, Jr. | |
| 2,898,971 | A | 8/1959 | Hempel | |
| 2,978,047 | A | 4/1961 | DeVaan | |
| 3,006,415 | A | 10/1961 | Burns et al. | |
| 3,028,915 | A | 4/1962 | Jennings | |
| 3,036,530 | A | 5/1962 | Mills et al. | 104/155 |
| 3,039,530 | A | 6/1962 | Condra | |
| 3,087,546 | A | 4/1963 | Wooley | |
| 3,102,599 | A | 9/1963 | Hillburn | |
| 3,117,636 | A | 1/1964 | Wilcox et al. | |
| 3,122,811 | A | 3/1964 | Gilreath | 24/263 |
| 3,123,160 | A | 3/1964 | Kammerer | 175/82 |
| 3,159,219 | A | 12/1964 | Scott | 166/156 |
| 3,167,122 | A | 1/1965 | Lang | |
| 3,169,592 | A | 2/1965 | Kammerer | |
| 3,179,168 | A | 4/1965 | Vincent | |
| 3,186,485 | A | 6/1965 | Owen | |
| 3,191,677 | A | 6/1965 | Kinley | |
| 3,191,680 | A | 6/1965 | Vincent | |
| 3,195,646 | A | 7/1965 | Brown | |
| 3,203,451 | A | 8/1965 | Vincent | |
| 3,203,483 | A | 8/1965 | Vincent | |
| 3,245,471 | A | 4/1966 | Howard | |
| 3,297,092 | A | 1/1967 | Jennings | |
| 3,326,293 | A | 6/1967 | Skipper | |
| 3,353,599 | A | 11/1967 | Swift | |
| 3,354,955 | A | 11/1967 | Berry | |
| 3,380,528 | A | 4/1968 | Timmons | 166/14 |
| 3,387,893 | A | 6/1968 | Hoever | |
| 3,392,609 | A | 7/1968 | Bartos | 81/57 |
| 3,467,180 | A | 9/1969 | Pensotti | |
| 3,477,506 | A | 11/1969 | Malone | |
| 3,489,220 | A | 1/1970 | Kinley | |
| 3,518,903 | A | 7/1970 | Ham et al. | 81/57.16 |
| 3,550,684 | A | 12/1970 | Cubberly, Jr. | 166/250 |
| 3,552,507 | A * | 1/1971 | Brown | 175/258 |
| 3,552,508 | A | 1/1971 | Brown | |
| 3,552,509 | A | 1/1971 | Brown | 175/258 |
| 3,552,510 | A | 1/1971 | Brown | 175/261 |
| 3,559,739 | A | 2/1971 | Hutchison | 166/311 |
| 3,570,598 | A | 3/1971 | Johnson | 166/178 |
| 3,575,245 | A | 4/1971 | Cordary et al. | |
| 3,583,200 | A | 6/1971 | Cvijanovic et al. | |
| 3,603,411 | A | 9/1971 | Link | |
| 3,603,412 | A | 9/1971 | Kammerer, Jr. et al. | 175/260 |
| 3,603,413 | A | 9/1971 | Grill et al. | 175/261 |
| 3,624,760 | A | 11/1971 | Bodine | |
| 3,656,564 | A | 4/1972 | Brown | 175/228 |
| 3,669,190 | A | 6/1972 | Sizer et al. | |
| 3,689,113 | A | 9/1972 | Blaschke | |
| 3,691,624 | A | 9/1972 | Kinley | |
| 3,692,126 | A | 9/1972 | Rushing et al. | 175/259 |
| 3,700,048 | A | 10/1972 | Desmoulins | |
| 3,712,376 | A | 1/1973 | Owen et al. | |
| 3,729,057 | A | 4/1973 | Werner | 175/262 |
| 3,746,091 | A | 7/1973 | Owen et al. | |
| 3,747,675 | A | 7/1973 | Brown | 166/237 |
| 3,760,894 | A | 9/1973 | Pitifer | |
| 3,776,307 | A | 12/1973 | Young | |
| 3,780,562 | A | 12/1973 | Kinley | |
| 3,785,193 | A | 1/1974 | Kinley et al. | |
| 3,808,916 | A | 5/1974 | Porter et al. | 81/57.19 |
| 3,818,734 | A | 6/1974 | Bateman | |
| 3,820,370 | A | 6/1974 | Duffy | |
| 3,827,512 | A | 8/1974 | Edmond | |
| 3,838,613 | A | 10/1974 | Wilms | 81/57.34 |
| 3,840,128 | A | 10/1974 | Swoboda, Jr. et al. | 214/1 |
| 3,870,114 | A | 3/1975 | Pulk et al. | 175/258 |
| 3,881,375 | A | 5/1975 | Kelly | 81/57.35 |
| 3,885,679 | A | 5/1975 | Swoboda, Jr. et al. | 214/1 |
| 3,888,319 | A | 6/1975 | Bourne, Jr. et al. | |
| 3,890,905 | A | 6/1975 | Clavin | |
| 3,901,331 | A | 8/1975 | Djurovic | |
| 3,911,707 | A | 10/1975 | Minakov et al. | |
| 3,933,108 | A | 1/1976 | Baugh | 114/5 |
| 3,934,660 | A | 1/1976 | Nelson | |
| 3,945,444 | A | 3/1976 | Knudson | 175/92 |
| 3,948,321 | A | 4/1976 | Owen et al. | |
| 3,964,556 | A | 6/1976 | Gearhart et al. | 175/45 |
| 3,969,950 | A | 7/1976 | Rau et al. | |
| 3,977,076 | A | 8/1976 | Vieira et al. | |
| 3,980,143 | A | 9/1976 | Swartz et al. | 173/100 |
| 4,006,777 | A | 2/1977 | LaBauve | 166/250 |
| 4,009,561 | A | 3/1977 | Young | 57/6 |
| 4,031,750 | A | 6/1977 | Youmans et al. | |
| 4,049,066 | A | 9/1977 | Richey | 175/323 |
| 4,054,426 | A | 10/1977 | White | 51/309 |
| 4,063,602 | A | 12/1977 | Howell et al. | 175/7 |
| 4,064,939 | A | 12/1977 | Marquis | 166/253 |
| 4,069,573 | A | 1/1978 | Rogers, Jr. et al. | |
| 4,071,086 | A | 1/1978 | Bennett | |
| 4,077,525 | A | 3/1978 | Callegari et al. | 214/2.5 |
| 4,082,144 | A | 4/1978 | Marquis | 166/250 |
| 4,083,405 | A | 4/1978 | Shirley | |
| 4,085,808 | A | 4/1978 | Kling | |
| 4,100,968 | A | 7/1978 | Delano | 166/315 |
| 4,100,981 | A | 7/1978 | Chaffin | |
| 4,113,236 | A | 9/1978 | Neinast | 254/134.5 |
| 4,116,274 | A | 9/1978 | Rankin et al. | 166/250 |

4,127,168 A 11/1978 Hanson et al.
4,133,396 A 1/1979 Tschirky ..... 175/57
4,142,739 A 3/1979 Billingsley ..... 285/18
4,144,396 A 3/1979 Okano et al. ..... 560/246
4,159,564 A 7/1979 Cooper, Jr.
4,173,457 A 11/1979 Smith ..... 51/309
4,175,619 A 11/1979 Davis ..... 166/291
4,186,628 A 2/1980 Bonnice
4,189,185 A 2/1980 Kammerer, Jr. et al.
4,192,380 A 3/1980 Smith
4,194,383 A 3/1980 Huzyak ..... 72/245
4,221,269 A 9/1980 Hudson
4,227,197 A 10/1980 Nimmo et al. ..... 343/878
4,243,099 A 1/1981 Rodgers, Jr.
4,256,146 A 3/1981 Genini et al. ..... 138/111
4,257,442 A 3/1981 Claycomb ..... 137/238
4,262,693 A 4/1981 Giebeler ..... 137/494
4,274,777 A 6/1981 Scaggs ..... 414/22
4,274,778 A 6/1981 Putnam et al.
4,281,722 A 8/1981 Tucker et al. ..... 175/57
4,287,949 A 9/1981 Lindsey, Jr. ..... 166/212
4,288,082 A 9/1981 Setterberg, Jr.
4,291,772 A 9/1981 Beynet ..... 175/5
4,315,553 A 2/1982 Stallings ..... 175/207
4,319,393 A 3/1982 Pogonowski
4,320,915 A 3/1982 Abbott et al. ..... 294/96
4,324,407 A 4/1982 Upham et al.
4,336,415 A 6/1982 Walling ..... 174/47
4,349,050 A 9/1982 Bergstrom et al.
4,359,889 A 11/1982 Kelly
4,362,324 A 12/1982 Kelly
4,382,379 A 5/1983 Kelly
4,384,627 A 5/1983 Ramirez-Jauregui ..... 175/260
4,387,502 A 6/1983 Dom
4,396,076 A 8/1983 Inoue
4,396,077 A 8/1983 Radtke
4,407,150 A 10/1983 Kelly
4,408,669 A 10/1983 Wiredal ..... 175/258
4,413,682 A 11/1983 Callihan et al. ..... 166/382
4,414,739 A 11/1983 Kelly
4,429,620 A 2/1984 Burkhardt et al.
4,430,892 A 2/1984 Owings ..... 73/151
4,440,220 A 4/1984 McArthur ..... 166/85
4,445,201 A 4/1984 Pricer
4,446,745 A 5/1984 Stone et al.
4,450,612 A 5/1984 Kelly
4,460,053 A 7/1984 Jurgens et al. ..... 175/329
4,463,814 A 8/1984 Horstmeyer et al.
4,466,498 A 8/1984 Bardwell
4,470,280 A 9/1984 Kelly
4,470,470 A 9/1984 Takano ..... 175/260
4,472,002 A 9/1984 Beney et al. ..... 308/3.9
4,474,243 A 10/1984 Gaines ..... 166/362
4,483,399 A 11/1984 Colgate
4,487,630 A 12/1984 Crook et al.
4,489,793 A 12/1984 Boren
4,502,308 A 3/1985 Kelly
4,505,142 A 3/1985 Kelly
4,505,612 A 3/1985 Shelley, Jr.
4,515,045 A 5/1985 Gnatchenko et al.
4,531,581 A 7/1985 Pringle et al.
4,534,426 A 8/1985 Hooper ..... 175/65
4,544,041 A 10/1985 Rinaldi ..... 175/57
4,545,443 A 10/1985 Wiredal ..... 175/258
4,567,631 A 2/1986 Kelly
4,570,709 A 2/1986 Wittrisch
4,580,631 A 4/1986 Baugh ..... 166/208
4,581,617 A 4/1986 Yoshimoto et al.
4,583,603 A 4/1986 Dorleans et al. ..... 175/324
4,588,030 A 5/1986 Blizzard
4,589,495 A 5/1986 Langer et al. ..... 166/383
4,595,058 A 6/1986 Nations
4,604,724 A 8/1986 Shaginian et al. ..... 364/478
4,604,818 A 8/1986 Inoue
4,605,077 A 8/1986 Boyadjieff ..... 175/85
4,620,600 A 11/1986 Persson
4,624,306 A 11/1986 Traver et al.
4,626,129 A 12/1986 Kothmann et al.
4,630,691 A 12/1986 Hooper ..... 175/65
4,643,377 A 2/1987 Christianson
4,651,837 A 3/1987 Mayfield
4,652,195 A 3/1987 McArthur ..... 414/22
4,655,286 A 4/1987 Wood ..... 166/285
4,671,358 A 6/1987 Lindsey, Jr. et al. ..... 166/291
4,676,310 A 6/1987 Scherbatskoy et al. .... 166/65.1
4,681,158 A 7/1987 Pennison
4,686,653 A 8/1987 Staron et al.
4,686,873 A 8/1987 Lang et al. ..... 81/57.35
4,691,587 A 9/1987 Farrand et al. ..... 74/493
4,697,640 A 10/1987 Szarka
4,699,224 A 10/1987 Burton
4,725,179 A 2/1988 Woolslayer et al. ..... 414/22
4,735,270 A 4/1988 Fenyvesi ..... 175/113
4,750,559 A 6/1988 Greenlee et al.
4,760,882 A 8/1988 Novak ..... 166/295
4,762,187 A 8/1988 Haney ..... 175/71
4,765,416 A * 8/1988 Bjerking et al. ..... 175/71
4,807,704 A 2/1989 Hsu et al.
4,813,495 A 3/1989 Leach ..... 175/6
4,825,947 A 5/1989 Mikolajczyk
4,832,552 A 5/1989 Skelly ..... 414/22.54
4,836,299 A 6/1989 Bodine
4,840,128 A 6/1989 McFarlane et al. ..... 108/50
4,842,081 A 6/1989 Parant ..... 175/23
4,843,945 A 7/1989 Dinsdale ..... 81/57.34
4,848,469 A 7/1989 Baugh et al.
4,854,386 A 8/1989 Baker et al. ..... 166/289
4,866,966 A 9/1989 Hagen
4,880,058 A 11/1989 Lindsey et al. ..... 166/289
4,883,121 A 11/1989 Zwart
4,883,125 A 11/1989 Wilson et al.
4,904,119 A 2/1990 Legendre et al.
4,909,741 A 3/1990 Schasteen et al. ..... 439/13
4,921,386 A 5/1990 McArthur ..... 414/22.51
4,960,173 A 10/1990 Cognevich et al.
4,962,819 A 10/1990 Bailey et al.
4,962,822 A 10/1990 Pascale
4,976,322 A 12/1990 Abdrakhmanov et al.
4,997,042 A 3/1991 Jordan et al. ..... 166/379
4,997,320 A 3/1991 Hwang
5,009,265 A 4/1991 Bailey et al. ..... 166/118
5,014,779 A 5/1991 Meling et al.
5,018,451 A 5/1991 Hapstack
5,022,472 A 6/1991 Bailey et al. ..... 175/195
5,027,914 A 7/1991 Wilson ..... 175/406
5,040,619 A 8/1991 Jordan et al.
5,049,020 A 9/1991 McArthur ..... 414/22.51
5,052,483 A 10/1991 Hudson
5,052,849 A 10/1991 Zwart
5,060,542 A 10/1991 Hauk ..... 81/57.34
5,060,737 A 10/1991 Mohn ..... 175/104
5,069,297 A 12/1991 Krueger
5,074,366 A 12/1991 Karlsson et al. ..... 175/76
5,082,069 A 1/1992 Seiler et al. ..... 175/5
5,096,465 A 3/1992 Chen et al. ..... 51/295
5,109,924 A 5/1992 Jurgens et al.
5,111,893 A 5/1992 Kvello-Aune ..... 175/258
5,121,694 A 6/1992 Zollinger
5,141,063 A 8/1992 Quesenbury
5,148,875 A 9/1992 Karlsson et al. ..... 175/62
5,156,209 A 10/1992 McHardy
5,156,213 A 10/1992 George et al. ..... 166/297

5,160,925 A 11/1992 Dailey et al. ..... 340/853.3
5,168,942 A 12/1992 Wydrinski ..... 175/50
5,172,765 A 12/1992 Sas-Jaworsky ..... 166/384
5,176,180 A 1/1993 Williams et al. ..... 138/172
5,176,518 A 1/1993 Hordijk et al. ..... 434/37
5,181,571 A 1/1993 Mueller et al.
5,184,676 A 2/1993 Graham et al.
5,186,265 A 2/1993 Henson et al. ..... 175/107
5,191,932 A 3/1993 Seefried et al.
5,191,939 A 3/1993 Stokley ..... 166/379
5,197,553 A 3/1993 Leturno
5,209,302 A 5/1993 Robichaux et al. ..... 166/355
5,209,304 A 5/1993 Nice
5,234,052 A 8/1993 Coone et al. ..... 166/155
5,255,741 A 10/1993 Alexander ..... 166/278
5,255,751 A 10/1993 Stogner ..... 175/203
5,267,613 A 12/1993 Zwart et al.
5,271,427 A 12/1993 Berchem
5,271,472 A 12/1993 Leturno ..... 175/107
5,282,653 A 2/1994 LaFleur et al. ..... 285/110
5,285,008 A 2/1994 Sas-Jaworsky et al. ..... 174/47
5,285,204 A 2/1994 Sas-Jaworsky ..... 340/854.9
5,291,956 A 3/1994 Mueller et al. ..... 175/67
5,294,228 A 3/1994 Willis et al. ..... 414/22.55
5,297,833 A 3/1994 Willis et al. ..... 294/102.2
5,301,760 A 4/1994 Graham
5,305,830 A 4/1994 Wittrisch ..... 166/250
5,307,879 A 5/1994 Kent
5,318,122 A 6/1994 Murray et al.
5,320,178 A 6/1994 Cornette ..... 175/19
5,322,127 A 6/1994 McNair et al.
5,323,858 A 6/1994 Jones et al. ..... 166/291
5,332,048 A 7/1994 Underwood et al.
5,339,899 A 8/1994 Ravi et al. ..... 166/250
5,343,950 A 9/1994 Hale et al.
5,343,951 A 9/1994 Cowan et al.
5,348,095 A 9/1994 Worrall et al.
5,353,872 A 10/1994 Wittrisch ..... 166/250
5,354,150 A 10/1994 Canales ..... 405/154
5,355,967 A 10/1994 Mueller et al. ..... 175/65
5,361,859 A 11/1994 Tibbitts
5,366,012 A 11/1994 Lohbeck
5,368,113 A 11/1994 Schulze-Beckinghausen ..... 175/162
5,375,668 A 12/1994 Hallundbaek
5,379,835 A 1/1995 Streich ..... 166/181
5,386,746 A 2/1995 Hauk ..... 81/57.34
5,392,715 A 2/1995 Pelrine ..... 104/138.2
5,398,760 A 3/1995 George et al. ..... 166/297
5,402,856 A 4/1995 Warren et al.
5,409,059 A 4/1995 McHardy
5,412,568 A 5/1995 Schultz ..... 364/422
5,435,400 A 7/1995 Smith
5,452,923 A 9/1995 Smith ..... 285/145
5,458,209 A 10/1995 Hayes et al.
5,472,057 A 12/1995 Winfree ..... 175/57
5,477,925 A 12/1995 Trahan et al.
5,484,021 A 1/1996 Hailey
5,497,840 A 3/1996 Hudson ..... 175/72
5,520,255 A 5/1996 Barr et al.
5,526,880 A 6/1996 Jordan, Jr. et al.
5,535,824 A 7/1996 Hudson ..... 166/207
5,535,838 A 7/1996 Keshavan et al. ..... 175/374
5,546,317 A 8/1996 Andrieu
5,547,029 A 8/1996 Rubbo et al. ..... 166/375
5,547,314 A 8/1996 Ames
5,551,521 A 9/1996 Vail, III ..... 175/65
5,553,672 A 9/1996 Smith, Jr. et al. ..... 166/382
5,553,679 A 9/1996 Thorp
5,560,426 A 10/1996 Trahan et al.
5,560,437 A 10/1996 Dickel et al. ..... 175/40
5,560,440 A 10/1996 Tibbitts
5,575,344 A 11/1996 Wireman
5,582,259 A 12/1996 Barr ..... 175/73
5,584,343 A 12/1996 Coone ..... 166/387
5,613,567 A 3/1997 Hudson
5,615,747 A 4/1997 Vail, III
5,636,661 A 6/1997 Moyes
5,651,420 A 7/1997 Tibbitts et al. ..... 175/102
5,661,888 A 9/1997 Hanslik ..... 29/407.02
5,662,170 A 9/1997 Donovan et al. ..... 166/358
5,662,182 A 9/1997 McLeod et al. ..... 175/258
5,667,011 A 9/1997 Gill et al. ..... 166/295
5,667,023 A 9/1997 Harrell et al. ..... 175/45
5,667,026 A 9/1997 Lorenz et al. ..... 175/162
5,685,369 A 11/1997 Ellis et al.
5,706,905 A 1/1998 Barr
5,711,382 A 1/1998 Hansen et al. ..... 175/52
5,717,334 A 2/1998 Vail, III et al.
5,720,356 A 2/1998 Gardes ..... 175/62
5,725,060 A 3/1998 Blount et al.
5,727,629 A 3/1998 Blizzard, Jr. et al.
5,732,776 A 3/1998 Tubel et al. ..... 166/250.15
5,735,348 A 4/1998 Hawkins, III ..... 166/285
5,743,344 A 4/1998 McLeod et al. ..... 175/259
5,746,276 A 5/1998 Stuart ..... 173/1
5,769,160 A 6/1998 Owens ..... 166/65.1
5,785,120 A 7/1998 Smalley et al.
5,785,132 A 7/1998 Richardson et al.
5,785,134 A 7/1998 McLeod et al. ..... 175/258
5,787,978 A 8/1998 Carter et al.
5,794,703 A 8/1998 Newman et al.
5,803,666 A 9/1998 Keller
5,804,713 A 9/1998 Kluth ..... 73/152.01
5,809,549 A 9/1998 Thome et al. ..... 175/71
5,826,651 A 10/1998 Lee et al.
5,828,003 A 10/1998 Thomeer et al. ..... 174/69
5,829,520 A 11/1998 Johnson ..... 166/250.1
5,833,002 A 11/1998 Holcombe
5,836,409 A 11/1998 Vail, III ..... 175/379
5,839,330 A 11/1998 Stokka ..... 81/57.33
5,839,519 A 11/1998 Spedale, Jr. ..... 175/57
5,842,149 A 11/1998 Harrell et al. ..... 702/9
5,842,530 A 12/1998 Smith et al. ..... 175/162
5,845,722 A 12/1998 Makohl et al. ..... 175/101
5,860,474 A 1/1999 Stoltz et al. ..... 166/50
5,878,815 A 3/1999 Collins
5,887,655 A 3/1999 Haugen et al.
5,887,668 A 3/1999 Haugen et al.
5,890,537 A 4/1999 Lavaure et al. ..... 166/285
5,894,897 A 4/1999 Vail, III ..... 175/318
5,901,787 A 5/1999 Boyle
5,901,789 A 5/1999 Donnelly et al.
5,907,664 A 5/1999 Wang et al. ..... 395/86
5,908,049 A 6/1999 Williams et al. ..... 138/125
5,913,337 A 6/1999 Williams et al. ..... 138/125
5,921,285 A 7/1999 Quigley et al. ..... 138/125
5,921,332 A 7/1999 Spedale, Jr. ..... 175/415
5,924,745 A 7/1999 Campbell
5,931,231 A 8/1999 Mock ..... 166/377
5,947,213 A 9/1999 Angle et al. ..... 175/24
5,950,742 A 9/1999 Caraway ..... 175/57
5,954,131 A 9/1999 Sallwasser ..... 166/254.2
5,957,225 A 9/1999 Sinor ..... 175/57
5,960,895 A 10/1999 Chevallier et al.
5,971,079 A 10/1999 Mullins ..... 166/387
5,979,571 A 11/1999 Scott et al.
6,000,472 A 12/1999 Albright et al. ..... 166/380
6,012,529 A 1/2000 Mikolajczyk et al.
6,021,850 A 2/2000 Wood et al.
6,024,168 A 2/2000 Kuck et al.
6,024,169 A 2/2000 Haugen 6,026,911 A 2/2000 Angle et al. ..... 175/24
6,029,748 A 2/2000 Forsyth et al.
6,035,953 A 3/2000 Rear
6,059,051 A 5/2000 Jewkes et al. ..... 175/76
6,059,053 A 5/2000 McLeod ..... 175/258
6,061,000 A 5/2000 Edwards ..... 340/854.6
6,062,326 A 5/2000 Strong et al. ..... 175/402
6,065,550 A 5/2000 Gardes ..... 175/62
6,070,671 A 6/2000 Cumming et al.
6,082,461 A 7/2000 Newman et al. ..... 166/381
6,089,323 A 7/2000 Newman et al. ..... 166/381
6,098,717 A 8/2000 Bailey et al.
6,119,772 A 9/2000 Pruet ..... 166/81.1
6,135,208 A 10/2000 Gano et al.
6,148,664 A 11/2000 Baird ..... 73/152.38
6,155,360 A 12/2000 McLeod
6,158,531 A 12/2000 Vail, III ..... 175/318
6,170,573 B1 1/2001 Brunet et al. ..... 166/153
6,172,010 B1 1/2001 Argillier et al. ..... 507/102
6,173,787 B1 1/2001 Wittrisch
6,179,055 B1 1/2001 Sallwasser et al. ..... 166/254.2
6,179,058 B1 1/2001 Wittrisch
6,182,776 B1 2/2001 Asberg ..... 175/300
6,186,233 B1 2/2001 Brunet
6,189,616 B1 2/2001 Gano et al.
6,189,621 B1 2/2001 Vail, III ..... 166/385
6,192,980 B1 2/2001 Tubel et al. ..... 166/65.1
6,196,336 B1 3/2001 Fincher et al. ..... 175/101
6,206,112 B1 3/2001 Dickinson, III et al. ..... 175/67
6,216,533 B1 4/2001 Woloson et al.
6,217,258 B1 4/2001 Yamamoto et al.
6,220,117 B1 4/2001 Butcher ..... 76/108.2
6,225,719 B1 5/2001 Hallundbaek ..... 310/90
6,234,257 B1 5/2001 Ciglenec et al. ..... 175/50
6,237,684 B1 5/2001 Bouligny, Jr. et al.
6,241,028 B1 6/2001 Bijleveld et al.
6,241,031 B1 6/2001 Beaufort et al.
6,257,332 B1 7/2001 Vidrine et al. ..... 166/250.15
6,263,987 B1 7/2001 Vail, III ..... 175/318
6,273,189 B1 8/2001 Gissler et al. ..... 166/241.1
6,273,190 B1 8/2001 Sawyer
6,296,066 B1 10/2001 Terry et al. ..... 175/92
6,305,469 B1 * 10/2001 Coenen et al. ..... 166/250.01
6,311,792 B1 11/2001 Scott et al. ..... 175/162
6,315,051 B1 11/2001 Ayling ..... 166/380
6,318,457 B1 11/2001 Den Boer et al.
6,318,466 B1 11/2001 Ohmer et al.
6,318,470 B1 11/2001 Chang et al.
6,325,148 B1 12/2001 Trahan et al. ..... 166/297
6,343,649 B1 2/2002 Beck et al. ..... 166/250.01
6,345,669 B1 2/2002 Buyers et al.
6,347,674 B1 2/2002 Bloom et al. ..... 175/51
6,354,373 B1 3/2002 Vercaemer et al. ..... 166/277
6,357,485 B1 3/2002 Quigley et al. ..... 138/125
6,359,569 B1 3/2002 Beck et al. ..... 340/856.3
6,371,203 B1 4/2002 Frank et al.
6,374,924 B1 4/2002 Hanton et al. ..... 176/6
6,378,627 B1 4/2002 Tubel et al. ..... 175/24
6,378,630 B1 4/2002 Ritorto et al. ..... 175/173
6,378,633 B1 4/2002 Moore
6,397,946 B1 6/2002 Vail, III ..... 166/250.01
6,405,798 B1 6/2002 Barrett et al. ..... 166/250.01
6,405,804 B1 6/2002 Ohmer et al.
6,408,943 B1 6/2002 Schultz et al. ..... 166/285
6,412,554 B1 7/2002 Allen et al. ..... 166/80.1
6,412,574 B1 7/2002 Wardley et al. ..... 175/7
6,419,014 B1 7/2002 Meek et al. ..... 166/255.2
6,419,033 B1 7/2002 Hahn et al. ..... 176/61
6,427,776 B1 8/2002 Hoffman et al. ..... 166/311
6,433,241 B1 8/2002 Wu et al.
6,443,241 B1 9/2002 Juhasz et al. ..... 175/52
6,443,247 B1 9/2002 Wardley ..... 175/402
6,457,532 B1 10/2002 Simpson
6,458,471 B1 10/2002 Lovato et al.
6,464,004 B1 10/2002 Crawford et al. ..... 166/250.01
6,464,011 B1 10/2002 Tubel
6,484,818 B1 11/2002 Alft et al. ..... 175/45
6,497,280 B1 12/2002 Beck et al. ..... 166/250.07
6,509,301 B1 1/2003 Vollmer ..... 507/236
6,527,047 B1 3/2003 Pietras ..... 166/77.51
6,527,064 B1 3/2003 Hallundbaek ..... 175/320
6,536,520 B1 3/2003 Snider et al. ..... 166/78.1
6,536,522 B1 3/2003 Birckhead et al.
6,536,993 B1 3/2003 Strong et al.
6,538,576 B1 3/2003 Schultz et al. ..... 340/859.6
6,543,538 B1 4/2003 Tolman et al. ..... 166/284
6,543,552 B1 4/2003 Metcalfe et al.
6,547,017 B1 4/2003 Vail, III ..... 175/379
6,554,064 B1 4/2003 Restarick et al. ..... 166/250.01
6,585,040 B1 7/2003 Hanton et al.
6,591,471 B1 7/2003 Hollingsworth et al. . 29/407.09
6,634,430 B1 10/2003 Dawson et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,702,040 B1 3/2004 Sensenig
6,708,769 B1 3/2004 Haugen et al.
6,725,924 B1 4/2004 Davidson et al.
6,742,606 B1 6/2004 Metcalfe et al.
6,745,834 B1 6/2004 Davis et al.
6,752,211 B1 6/2004 Dewey et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0134555 A1 9/2002 Allen et al.
2002/0157829 A1 10/2002 Davis et al.
2002/0162690 A1 11/2002 Hanton et al.
2002/0189806 A1 12/2002 Davidson et al.
2002/0189863 A1 12/2002 Wardley
2003/0034177 A1 2/2003 Chitwood et al.
2003/0056991 A1 3/2003 Hahn et al.
2003/0070841 A1 4/2003 Merecka et al.
2003/0111267 A1 6/2003 Pia
2003/0141111 A1 7/2003 Pia
2003/0146023 A1 8/2003 Pia
2003/0217865 A1 11/2003 Simpson et al.
2004/0003944 A1 * 1/2004 Vincent et al. ..... 175/57
2004/0011534 A1 * 1/2004 Simonds et al. ..... 166/384
2004/0016575 A1 1/2004 Shahin et al.
2004/0069501 A1 4/2004 Haugen et al.
2004/0216892 A1 11/2004 Giroux et al.
2004/0216924 A1 11/2004 Pietras et al.
2004/0221997 A1 11/2004 Giroux et al.
2004/0226751 A1 11/2004 McKay et al.
2004/0244992 A1 12/2004 Carter et al.
2004/0245020 A1 12/2004 Giroux et al.
2004/0251025 A1 12/2004 Giroux et al.

| | | | |
|---|---|---|---|
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |

FOREIGN PATENT DOCUMENTS

| | | |
|---|---|---|
| EP | 0 235 105 | 9/1987 |
| EP | 0 265 344 | 4/1988 |
| EP | 0 462 618 | 12/1991 |
| EP | 0479583 | 4/1992 |
| EP | 0 554 568 | 8/1993 |
| EP | 0 564 500 B1 | 10/1994 |
| EP | 0 952 305 | 4/1998 |
| EP | 0 571 045 | 8/1998 |
| EP | 0 961 007 | 12/1999 |
| EP | 1 006 260 | 6/2000 |
| EP | 1 050 661 | 11/2000 |
| EP | 1148206 | 10/2001 |
| FR | 2053088 | 7/1970 |
| GB | 540 027 | 10/1941 |
| GB | 709365 | 5/1954 |
| GB | 716761 | 10/1954 |
| GB | 7 303 38 | 3/1955 |
| GB | 7 928 86 | 4/1958 |
| GB | 8 388 33 | 6/1960 |
| GB | 881358 | 11/1961 |
| GB | 9 977 21 | 7/1965 |
| GB | 1 277 461 | 6/1972 |
| GB | 1 448 304 | 9/1976 |
| GB | 1 457 843 | 12/1976 |
| GB | 1 469 661 | 4/1977 |
| GB | 1 582 392 | 1/1981 |
| GB | 2 053 088 | 2/1981 |
| GB | 2 201 912 | 9/1988 |
| GB | 2 216 926 | 10/1989 |
| GB | 2294715 | 8/1996 |
| GB | 2 313 860 | 2/1997 |
| GB | 2 320 270 | 6/1998 |
| GB | 2 320 734 | 7/1998 |
| GB | 2 329 918 | 4/1999 |
| GB | 2 333 542 | 7/1999 |
| GB | 2 335 217 | 9/1999 |
| GB | 2347445 | 9/2000 |
| GB | 2 348 223 | 9/2000 |
| GB | 2 357 101 | 6/2001 |
| GB | 2 365 463 | 2/2002 |
| GB | 2381809 | 5/2003 |
| GB | 2 382 361 | 5/2003 |
| RU | 1618870 | 1/1991 |
| SU | 112631 | 1/1956 |
| SU | 695260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/18277 | 9/1993 |
| WO | WO 93/24728 | 12/1993 |
| WO | WO 93/25800 | 12/1993 |
| WO | WO 94/25655 | 11/1994 |
| WO | WO 95/10686 | 4/1995 |
| WO | WO 95/21987 | 8/1995 |
| WO | WO 96/28635 | 9/1996 |
| WO | WO 97/05360 | 2/1997 |
| WO | WO 97/08418 | 3/1997 |
| WO | WO 97/21901 | 6/1997 |
| WO | WO 98/00626 | 1/1998 |
| WO | WO 98/01651 | 1/1998 |
| WO | WO 98/06927 | 2/1998 |
| WO | WO 98/09053 | 3/1998 |
| WO | WO 98/55730 | 12/1998 |
| WO | WO 99/02818 | 1/1999 |
| WO | WO 99/04135 | 1/1999 |
| WO | WO 99/11902 | 3/1999 |
| WO | WO 99/18328 | 4/1999 |
| WO | WO 99/23354 | 5/1999 |
| WO | WO 99/24689 | 5/1999 |
| WO | WO 99/37881 | 7/1999 |
| WO | WO 99/50528 | 10/1999 |
| WO | WO 99/64713 | 12/1999 |
| WO | WO 00/05483 | 2/2000 |
| WO | WO 00/08293 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/50730 | 8/2000 |
| WO | WO 01/12946 | 2/2001 |
| WO | WO 01/46550 | 6/2001 |
| WO | WO 01/48352 | 7/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/03155 | 1/2002 |
| WO | WO 02/03156 | 1/2002 |
| WO | WO 02/086287 | 10/2002 |
| WO | WO 03/074836 | 9/2003 |

OTHER PUBLICATIONS

Rotary Drilling Series, The Rotary Rig and Its Components, Unit I, Lesson 1, Third Edition, The University of Texas at Austin, Austin, Texas.

Rotary Steerable Technology—Technology Gains Momentum, Oil & Gas Journal, Dec. 28, 1998.

Directional Drilling, M. Mims, World Oil, May 1999, pp. 40–43.

Multilateral Classification System w/Example Applications, Alan MacKenzie & Cliff Hogg, World Oil, Jan. 1999, pp. 55–61.

Rotary Drilling, Open–Hole Fishing, Unit III, Lesson 2, Third Edition.

Rotary Drilling, Casing and Cementing, Unit II, Lesson 4, Second Edition.

Rotary Drilling, Drilling a Straight Hole, Unit II, Lesson 3, Second Edition.

Rotary Drilling, The Bit, Unit I, Lesson 2, Third Edition.

Rotary Drilling, Blowout Prevention, Unit III, Lesson 3, Third Edition.

Well Servicing and Workover, Artificial Lift Methods, Lesson 5, Petroleum Extension Service, The University of Texas at Austin.
Rotary Drilling, Drilling Mud, Unit II, Lesson 2, Third Edition.
Rotary Drilling, Subsea Blowout Preventers and Marine Riser Systems, Unit III, Lesson 4.
Well Servicing and Workover, Control of Formation Pressure, Lesson 9, Petroleum Extension Service, The University of Texas at Austin.
Well Servicing and Workover, Production Rig Equipment, Lesson 6, Petroleum Extension Serivce, The University of Texas at Austin.
Well Servicing and Workover, Petroleum Geology and Reservoirs, Lesson 2, Petroleum Extension Service, The University of Texas at Austin.
Well Servicing and Workover, Well Logging Methods, Lesson 3, Petroleum Extension Service, The University of Texas at Austin.
Well Servicing and Workover, Introduction to Oil Well Service and Workover, Lesson 1, Petroleum Extension Service, The University of Texas at Austin.
Well Servicing and Workover, Well Completion Methods, Lesson 4, Petroleum Extension Service, The University of Texas at Austin.
Rotary Drilling, Controlled Directional Drilling, Unit III, Lesson 1, Third Edition.
Well Servicing and Workover, Well Stimulation Treatments, Lesson 11, Petroleum Extension Service, The University of Texas at Austin.
Rotary Drilling, Making Hole, Unit II, Lesson 1, Second Edition.
Well Servicing and Workover, Well Cleanout and Repair Methods, Lesson 8, Petroleum Extension Service, The University of Texas at Austin.
Well Servicing and Workover, Well Servicing and Repair, Lesson 7, Petroleum Extension Service, The University of Texas at Austin.
Rotary Drilling, Circulating Systems, Unit I, Lesson 8, Third Edition.
Well Servicing and Workover, Well Service and Workover Profitability, Lesson 12, Petroleum Extension Service, The University of Texas at Austin.
Rotary Drilling, Testing and Completing, Unit II, Lesson 5, Second Edition.
Well Servicing and Workover, Fishing Tools and Techniques, Lesson 10, Petroleum Extension Service, The University of Texas at Austin.
Rotary Drilling, The Drill Stem, Unit I, Lesson 3, Second Edition, The University of Texas at Austin, Austin, Texas.
Rotary Drilling Series, The Rotary Rig and Its Components, Unit I, Lesson 1, Third Edition, The University of Texas at Austin, Austin, Texas.
U.S. Appl. No. 10/618,093.
U.S. Appl. No. 10/382,353.
U.S. Appl. No. 10/382,080.
U.S. Appl. No. 10/335,957.
U.S. Appl. No. 10/331,964.
U.S. Appl. No. 10/325,636.
U.S. Appl. No. 10/319,792.
U.S. Appl. No. 10/269,661.
U.S. Appl. No. 10/189,570.
Tarr, et al., "Casing–while–Drilling: The Next Step Change In Well Construction," World Oil, Oct. 1999, pp. 34–40.
De Leon Mojarro, "Breaking A Paradigm: Drilling With Tubing Gas Wells," SPE Paper 40051, SPE Annual Technical Conference And Exhibition, Mar. 3–5, 1998, pp. 465–472.
De Leon Mojarro, "Drilling/Completing With Tubing Cuts Well Costs By 30%," World Oil, Jul. 1998, pp. 145–150.
Littleton, "Refined Slimhole Drilling Technology Renews Operator Interest," Petroleum Engineer International, Jun. 1992, pp. 19–26.
Anon, "Slim Holes Fat Savings," Journal of Petroleum Technology, Sep. 1992, pp. 816–819.
Anon, "Slim Holes, Slimmer Prospect," Journal of Petroleum Technology, Nov. 1995, pp. 949–952.
Vogt, et al., "Drilling Liner Technology For Depleted Reservoir," SPE Paper 36827, SPE Annual Technical Conference And Exhibition, Oct. 22–24, pp. 127–132.
Jafer, et al., "Discussion And Comparison Of Performance Of Horizontal Wells In Bouri Field," SPE Paper 36927, SPE Annual Technical Conference And Exhibition, Oct. 22–24, 1996, pp. 465–473.
Boykin, "The Role Of A Worldwide Drilling Organization And The Road To The Future," SPE/IADC Paper 37630, SPE/IADC Drilling Conference, Mar. 4–6, 1997, pp. 489–498.
Mojarro, et al., "Drilling/Completing With Tubing Cuts Well Costs By 30%," World Oil, Jul. 1998, pp. 145–150.
Sinor, et al., Rotary Liner Drilling For Depleted Reservoirs, IADC/SPE Paper 39399, IADC/SPE Drilling Conference, Mar. 3–6, 1998, pp 1–13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9–11, 1999, pp. 221–229.
Santos, et al., "Consequences And Relevance Of Drillstring Vibration On Wellbore Stability," SPE/IADC Paper 52820, SPE/IADC Drilling Conference, Mar. 9–11, 1999, pp. 25–31.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99–120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99–121, CADE/CAODC Spring Drilling Conference, Apr. 7 & 8, 1999, pp. 1–12.
Tessari, et al., "Focus: Drilling With Casing Promises Major Benefits," Oil & Gas Journal, May 17, 1999, pp. 58–62.
Laurent, et al., "Hydraulic Rig Supports Casing Drilling," World Oil, Sep. 1999, pp. 61–68.
Perdue, et al., "Casing Technology Improves," Hart's E & P, Nov. 1999, pp. 135–136.
Warren, et al. "Casing Drilling Application Design Considerations," IADC/SPE Paper 59179, IADC/SPE Drilling Conference, Feb. 23–25, 2000 pp 1–11.
Warren, et al., "Drilling Technology: Part I—Casing Drilling With Directional Steering In The U.S. Gulf Of Mexico," Offshore, Jan. 2001, pp. 50–52.

Warren, et al., "Drilling Technology: Part II—Casing Drilling With Directional Steering In The Gulf Of Mexico," Offshore, Feb. 2001, pp. 40–42.
Shepard, et al., "Casing Drilling: An Emerging Technology," IADC/SPE Paper 67731, SPE/IADC Drilling Conference, Feb. 27–Mar. 1, 2001, pp. 1–13.
Editor, "Tesco Finishes Field Trial Program," Drilling Contractor, Mar./Apr. 2001, p. 53.
Warren, et al., "Casing Drilling Technology Moves To More Challenging Application," AADE Paper 01–NC–HO–32, AADE National Drilling Conference, Mar. 27–29, 2001, pp. 1–10.
Shephard, et al., "Casing Drilling: An Emerging Technology," SPE Drilling & Completion, Mar. 2002, pp. 4–14.
Shephard, et al., "Casing Drilling Successfully Applied In Southern Wyoming," World Oil, Jun. 2002, pp. 33–41.
Forest, et al., "Subsea Equipment For Deep Water Drilling Using Dual Gradient Mud System," SPE/IADC Drilling Conference, Amsterdam, The Netherlands, Feb. 27, 2001–Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3–6, 1999, pp. 1–16.
Lohefer, et al., "Expandable Liner Hanger Provides Cost–Effective Alternative Solution," IADC/SPE Paper 59151, IADC/SPE Drilling Conference, Feb. 23–25, 2000, pp. 1–12.
Daigle, et al., "Expandable Tubulars: Field Examples Of Application In Well Construction And Remediation," SPE Paper 62958, SPE Annual Technical Conference And Exhibition, Oct. 1–4, 2000, pp. 1–14.
Dupal, et al., "Solid Expandable Tubular Technology—A Year Of Case Histories In The Drilling Environment," SPE/IADC Paper 67770, SP:E/IADC Drilling Conference, Feb. 27–Mar. 1, 2001, pp. 1–16.
Coronado, et al., "Development Of A One–Trip ECP Cement Inflation And Stage Cementing System For Open Hole Completions," IADC/SPE Paper 39345, IADC/SPE Drilling Conference, Mar. 3–6, 1998, pp. 473–481.
Fuller, et al., "Innovative Way To Cement A Liner Utilizing A New Liner String Liner Cementing Process," IADC/SPE Paper 39349, IADC/SPE Drilling Conference, Mar. 3–6, 1998, pp. 501–504.
Coronado, et al., "A One–Trip External–Casing–Packer Cement–Inflation And Stage–Cementing System," Journal Of Petroleum Technology, Aug. 1998, pp. 76–77.
Camesa, Inc., "Electromechanical Cable," Dec. 1998, pp. 1–32.
The Rochester Corporation, "Well Logging Cables," Jul. 1999, 9 pages.
Quigley, "Coiled Tubing And Its Applications," SPE Short Course, Houston, Texas, Oct. 3, 1999, 9 pages.
"World Oil's Coiled Tubing handbook," Gulf Publishing Co., 1993, p. 3, p. 5, pp. 45–50.
Sas–Joworsky, et al., "Development Of Composite Coiled Tubing For Oilfield Services," SPE Paper 26536, SPE Annual Technical Conference And Exhibition, Oct. 3–6, 1993, pp. 1–15.
Hallunbaek, "Well Tractors For Highly Deviated And Horizontal Wells," SPE paper 028871, SPE European Petroleum Conference, Oct. 25–27, 1994, pp. 57–62.
Leising, et al., "Extending The Reach Of Coiled Tubing Drilling (thrusters, Equalizers And Tractors)", SPE/IADC Paper 37656, SPE/IADC Drilling Conference, Mar. 4–6, 1997, pp. 677–690.
Bayfiled, et al., "Burst And Collapse Of A Sealed Multilateral Junction: Numerical Simulations," SPE/IADC Paper 52873, SPE/IADC Drilling Conference, Mar. 9–11, 1999, 8 pages.
Marker, et al., "Anaconda: Joint Development Project Leads To Digitally Controlled Composite Coiled Tubing Drilling System," SPE paper 60750, SPE/ICOTA Coiled Tubing Roundtable, Apr. 5–6, 2000, pp 1–9.
Bullock, et al., "Using Expandable Solid Tubulars To Solve Well Construction Challenges In Deep Waters And Maturing Properties," IBP Paper 275 00, Rio Oil & Gas Conference, Oct. 16–19, 2000, pp. 1–4.
Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
McSpadden, et al., "Field Validation Of 3–Dimensional Drag Model For Tractor And Cable–Conveyed Well Intervention," SPE Paper 71560, SPE Annual Technical Conference And Exhibition, Sep. 30–Oct. 3, 2001, pp. 1–8.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10–12, 2002, pp. 1–7.
Sander, et al., "Project Management And Technology Provide Enhanced Performance For Shallow Horizontal Wells," IADC/SPE Paper 74466, IADC/SPE Drilling Conference, Feb. 26–28, 2002, pp. 1–9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26–28, 2002, pp 1–7.
Editor, "New Downhole Tractor Put To Work," World Oil, Jun. 2000, pp. 75–76.
Henderson, et al., "Cost Saving Benefits Of Using A Fully Bi–Directional Tractor System," SPE/Petroleum Society Of CIM Paper 65467, SPE/Petroleum Society Of CIM International Conference On Horizontal Well Technology, Nov. 6–8, 2000, pp. 1–3.
Editor, "Shell Runs Smart Robot Tractor," Hart's E & P, Oct. 2002, p. 28.
Galloway, "Rotary Drilling With Casing—A Field Proven Method Of Reducing Wellbore Construction Cost," Paper WOCD–0306092, World Oil Casing Drilling Technical Conference, Mar. 6–7, 2003, pp. 1–7.
Evans, et al., "Development And Testing Of An Economical Casing Connection For Use In Drilling Operations," paper WOCD–0306–03, World Oil Casing Drilling Technical Conference, Mar. 6–7, 2003, pp. 1–10.
Fontenot, et al., "New Rig Design Enhances Casing Drilling Operations In Lobo Trend," paper WOCD–0306–04, World Oil Casing Drilling Technical Conference, Mar. 6–7, 2003, pp. 1–13.
McKay, et al., "New Developments In The Technology Of Drilling With Casing: Utilizing A Displaceable DrillShoe Tool," Paper WODC–0306–05, World Oil Casing Drilling Technical Conference, Mar. 6–7, 2003, pp. 1–11.

Sutriono–Santos, et al., "Drilling With Casing Advances To Floating Drilling Unit With Surface BOP Employed," Paper WOCD–0307–01, World Oil Casing Drilling Technical Conference, Mar. 6–7, 2003, pp. 1–7.
Vincent, et al., "Liner And Casing Drilling—Case Histories And Technology," Paper WOCD–0307–02, World Oil Casing Drilling Technical Conference, Mar. 6–7, 2003, pp. 1–20.
Maute, "Electrical Logging: State–of–the–Art," The Log Analyst, May–Jun. 1992, pp. 206–227.
Tessari, et al., "Retrievable Tools Provide Flexibility for Casing Drilling," Paper No. WOCD–0306–01, World Oil Casing Drilling Technical Conference, 2003, pp. 1–11.
Hahn, et al., "Simultaneous Drill and Case Technology—Case Histories, Status and Options for Futher Development," Society of Petroleum Engineers, IADC/SPE Drilling Conference, New Orlean, LA Feb. 23–25, 2000 pp. 1–9.
PCT International Search Report PCT/GB 03/01103, dated Jul. 14, 2003.
U.K. Search Report GB 0329523.5, dated Feb. 25, 2004.
U.K. Search Report GB 0328864.4, dated May 12, 2004.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124–130.
"First Success with Casing–Drilling" Word Oil, Feb. (1999), pp. 25.
Dean E. Gaddy, Editor, "Russia Shares Technical Know–How with U.S." Oil & Gas Journal, Mar. (1999), pp. 51–52 and 54–56.
U.S. Appl. No. 10/794,800, filed Mar. 5, 2004 (WEAT/0360).
U.S. Appl. No. 10/832,804, filed Apr. 27, 2004 (WEAT/0383.P1).
U.S. Appl. No. 10/795,214, filed Mar. 5, 2004 (WEAT/0373).
U.S. Appl. No. 10/794,795, filed Mar. 5, 2004 (WEAT/0357).
U.S. Appl. No. 10/775,048, filed Feb. 9, 2004 (WEAT/0359).
U.S. Appl. No. 10/772,217, filed Feb. 2, 2004 (WEAT/0344).
U.S. Appl. No. 10/788,976, filed Feb. 27, 2004.
U.S. Appl. No. 10/794,797, filed Mar. 5, 2004 (WEAT/0371).
U.S. Appl. No. 10/767,322, filed Jan. 29, 2004 (WEAT/0343).
U.S. Appl. No. 10/795,129, filed Mar. 5, 2004 (WEAT/0366).
U.S. Appl. No. 10/794,790, filed Mar. 5, 2004 (WEAT/0329).
U.S. Appl. No. 10/162,302, filed Jun. 4, 2004 (WEAT/0410).

* cited by examiner

METHOD AND APPARATUS FOR CEMENTING DRILL STRINGS IN PLACE FOR ONE PASS DRILLING AND COMPLETION OF OIL AND GAS WELLS

CROSS-REFERENCE TO RELATED APPLICATIONS

Portions of this application were disclosed in U.S. Disclosure Document No. 362582 filed on Sep. 30, 1994, which is incorporated herein by reference.

This application is a continuation of co-pending U.S. patent application Ser. No. 10/162,302, filed on Jun. 4, 2002 now U.S. Pat. No. 6,868,906, which is herein incorporated by reference in its entirety. U.S. patent application Ser. No. 10/162,302 is a continuation-in-part of U.S. patent application Ser. No. 09/487,197 filed on Jan. 19, 2000, now U.S. Pat. No. 6,397,946, which is herein incorporated by reference in its entirety. U.S. Pat. No. 6,397,946 is a continuation-in-part of U.S. patent application Ser. No. 09/295,808 filed on Apr. 20, 1999, now U.S. Pat. No. 6,263,987, which is herein incorporated by reference in its entirety. U.S. Pat. No. 6,263,987 is a continuation-in-part of U.S. patent application Ser. No. 08/708,396 filed on Sep. 3, 1996, now U.S. Pat. No. 5,894,897, which is incorporated herein by reference in its entirety. U.S. Pat. No. 5,894,897 is a continuation-in-part of U.S. patent application Ser. No. 08/323,152 filed on Oct. 14, 1994, now U.S. Pat. No. 5,551,521, which is herein incorporated by reference in its entirety.

This application further claims benefit of U.S. Provisional Patent Application Serial No. 60/313,654 filed on Aug. 19, 2001, U.S. Provisional Patent Application Serial No. 60/353,457 filed on Jan. 31, 2002, U.S. Provisional Patent Application Serial No. 60/367,638 filed on Mar. 26, 2002, and U.S. Provisional Patent Application Serial No. 60/384,964 filed on June 3, 2002. All of the above U.S. Provisional Patent Applications are herein incorporated by reference in their entirety.

BACKGROUND OF THE INVENTION

1. Field of Invention

The field of invention relates to apparatus that uses the steel drill string attached to a drilling bit during drilling operations used to drill oil and gas wells for a second purpose as the casing that is cemented in place during typical oil and gas well completions. The field of invention further relates to methods of operation of said apparatus that provides for the efficient installation a cemented steel cased well during one single pass down into the earth of the steel drill string. The field of invention further relates to methods of operation of the apparatus that uses the typical mud passages already present in a typical drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single drilling pass into the earth. The field of invention further relates to apparatus and methods of operation that provides the pumping of cement down the drill string, through the mud passages in the drill bit, and into the annulus between the formation and the drill string for the purpose of cementing the drill string and the drill bit into place during one single drilling pass into the formation. The field of invention further relates to a one-way cement valve and related devices installed near the drill bit of the drill string that allows the cement to set up efficiently while the drill string and drill bit are cemented into place during one single drilling pass into the formation.

2. Description of the Prior Art

From an historical perspective, completing oil and gas wells using rotary drilling techniques has in recent times comprised the following typical steps. With a pile driver or rotary rig, install any necessary conductor pipe on the surface for attachment of the blowout preventer and for mechanical support at the wellhead. Install and cement into place any surface casing necessary to prevent washouts and cave-ins near the surface, and to prevent the contamination of freshwater sands as directed by state and federal regulations. Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Drill the production well using a succession of rotary drill bits attached to the drill string until the hole is drilled to its final depth. After the final depth is reached, pull out the drill string and its attached drill bit. Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated buildup of hydrostatic pressure.

To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps. Introduce the Bottom Wiper Plug into the interior of the steel casing assembled in the well and pump down with cement that cleans the mud off the walls and separates the mud and cement. Introduce the Top Wiper Plug into the interior of the steel casing assembled into the well and pump down with water under pump pressure thereby forcing the cement through the float collar valve and any other one-way valves present. Allow the cement to cure.

SUMMARY OF THE INVENTION

Apparatus and methods of operation of that apparatus are disclosed that allow for cementation of a drill string with attached drill bit into place during one single drilling pass into a geological formation. The process of drilling the well and installing the casing becomes one single process that saves installation time and reduces costs during oil and gas well completion procedures. Apparatus and methods of operation of the apparatus are disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process"

that involves only 7 separate steps as described in the Description of the Preferred Embodiments below. The New Drilling Process is now possible because of "Several Recent Changes in the Industry" also described in the Description of the Preferred Embodiments below. In addition, the New Drilling Process also requires new apparatus to properly allow the cement to cure under ambient hydrostatic conditions. That new apparatus includes a Latching Subassembly, a Latching Float Collar Valve Assembly, the Bottom Wiper Plug, and the Top Wiper Plug. Suitable methods of operation are disclosed for the use of the new apparatus.

DESCRIPTION OF THE PREFERRED EMBODIMENTS

Figure 1:
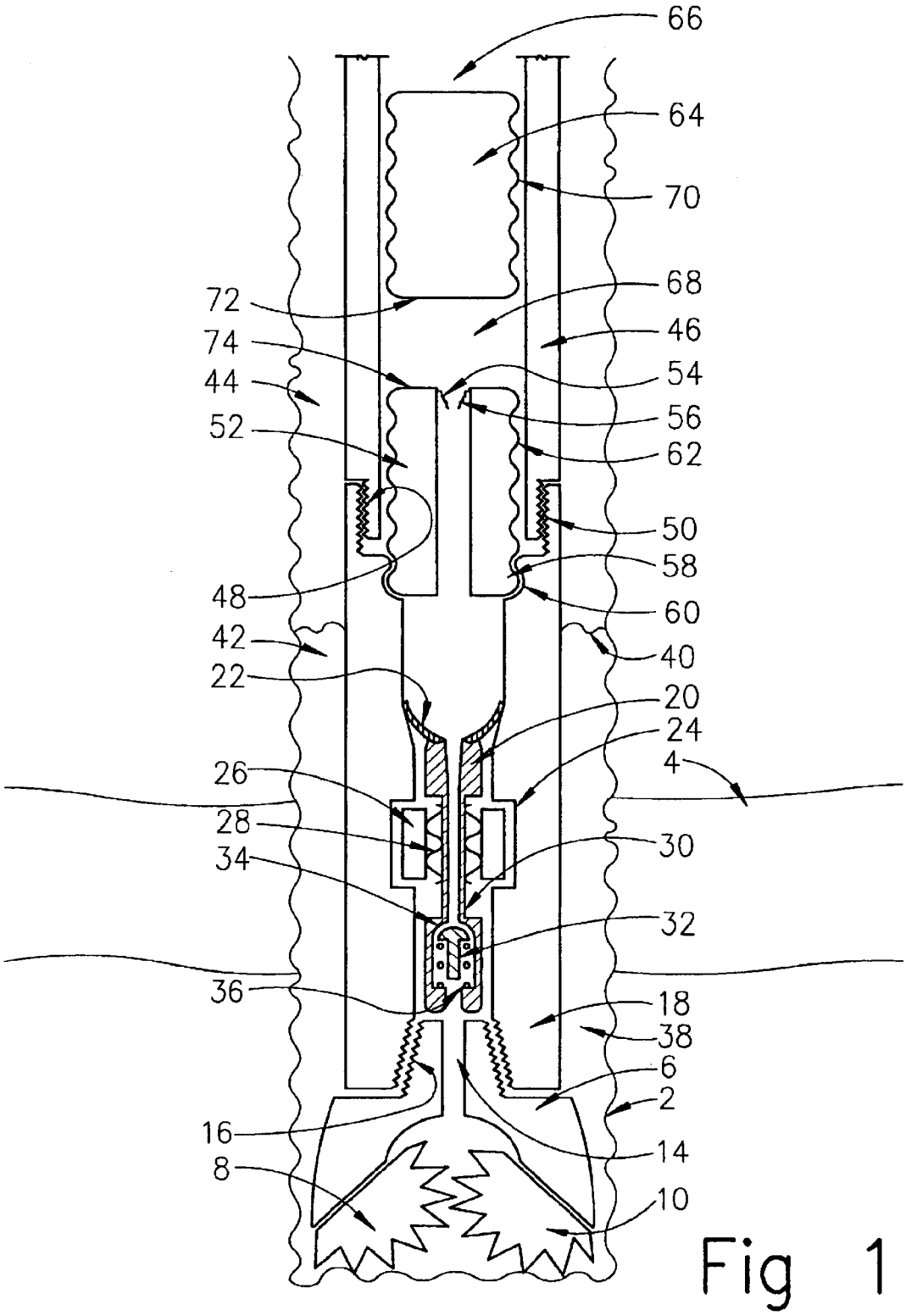
FIG. 1 shows a section view of a drill string in the process of being cemented in place during one drilling pass into formation with a preferred embodiment of the invention.

Apparatus and methods of operation of that apparatus are disclosed herein in the preferred embodiments of the invention that allow for cementation of a drill string with attached drill bit into place during one single drilling pass into a geological formation. The drill bit is the cutting or boring element used in drilling oil and gas wells. The method of drilling the well and installing the casing becomes one single process that saves installation time and reduces costs during oil and gas well completion procedures as documented in the following description of the preferred embodiments of the invention. Apparatus and methods of operation of the apparatus are disclosed herein that use the typical mud passages already present in a typical rotary drill bit, including any watercourses in a "regular bit", or mud jets in a "jet bit", for the second independent purpose of passing cement into the annulus between the casing and the well while cementing the drill string in place.

FIG. 1 shows a section view of a drill string in the process of being cemented in place during one drilling pass into formation. Often, the drill string is the term loosely applied to both drill pipe and drill collars. Drill collars provide weight on the bit to keep it in firm contact with the bottom of the hole. Drill collars are primarily used to supply weight to the bit for drilling and to maintain weight to keep the drill string from bending or buckling. They also prevent doglegs by supporting and stabilizing the bit. A borehole 2 is drilled though the earth including geological formation 4. The borehole is the wellbore, or the hole made by drilling or boring. Drilling is boring a hole in the earth, usually to find and remove subsurface formation fluids such as oil and gas. The borehole 2 is drilled with a milled tooth rotary drill bit 6 having milled steel roller cones 8, 10, and 12 (not shown for simplicity). A standard water passage 14 is shown through the rotary cone drill bit. This rotary bit could equally be a tungsten carbide insert roller cone bit having jets for waterpassages, the principle of operation and the related apparatus being the same for either case for the preferred embodiment herein.

Where formations are relatively soft, a jet deflection bit may be employed in directional drilling to deviate the hole. Directional drilling is the intentional deviation of a wellbore from the vertical. Controlled directional drilling makes it possible to reach subsurface areas laterally remote from the point where the bit enters the earth. For a jet deflection bit, a conventional roller cone bit is modified by equipping it with one oversize nozzle and closing off or reducing others, or by replacing a roller cone with a large nozzle. The drill pipe and special bit are lowered into the hole, and the large jet is pointed so that, when pump pressure is applied, the jet washes out the side of the hole in a specific direction. The large nozzle erodes away one side of the hole so that the hole is deflected off vertical. The large amount of mud emitted from the enlarged jet washes away the formation in front of the bit, and the bit follows the path of least resistance. The path of the wellbore is the trajectory.

A basic requirement in drilling a directional well is some means of changing the course of the hole. Generally, a driller either uses a specially-designed deflection tool or modifies the bottomhole assembly he is using to drill ahead. A bottomhole assembly is a combination of drill collars, stabilizers, and associated equipment made up just above the bit. Ideally, altering the bottomhole assembly in a particular way enables the driller to control the amount and direction of bending and thereby to increase, decrease, or maintain drift angle as desired.

Deflection tools cause the bit to drill in a preferred direction because of the way the tool is designed or made up in the drill string. A stabilizer may be used to change the deviation angle in a well by controlling the location of the contact point between the hole and drill collars. The stabilizer is a tool placed near the bit, and often above it, in the drilling assembly. Conversely, stabilizers are used to maintain correct hole angle. To maintain hole angle, the driller may use a combination of large, heavy drill collars and stabilizers to minimize or eliminate bending. Any increase in stabilization of the bottomhole assembly increases the drift diameter of the hole being drilled. Stabilizers must be adequately supported by the wall of the hole if they are to effectively stabilize the bit and centralize the drill collars.

The threads 16 on rotary drill bit 6 are screwed into the Latching Subassembly 18. The Latching Subassembly 18 is also called the Latching Sub for simplicity herein. The Latching Sub 18 is a relatively thick-walled steel pipe having some functions similar to a standard drill collar.

The Latching Float Collar Valve Assembly 20 is pumped downhole with drilling mud after the depth of the well is reached. The Latching Float Collar Valve Assembly 20 is pumped downhole with mud pressure pushing against the Upper Seal 22 of the Latching Float Collar Valve Assembly 20. The Latching Float Collar Valve Assembly 20 latches into place into Latch Recession 24. The Latch 26 of the Latching Float Collar Valve Assembly 20 is shown latched into place with Latching Spring 28 pushing against Latching Mandrel 30.

The Float 32 of the Latching Float Collar Valve Assembly 20 seats against the Float Seating Surface 34 under the force from Float Collar Spring 36 that makes a one-way cement valve. However, the pressure applied to the mud or cement from the surface may force open the Float to allow mud or cement to be forced into the annulus generally designated as 38 in FIG. 1. This one-way cement valve is a particular example of "a one-way cement valve means installed near the drill bit" which is a term defined herein. The one-way cement valve means may be installed at any distance from the drill bit but is preferentially installed "near" the drill bit.

FIG. 1 corresponds to the situation where cement is in the process of being forced from the surface through the Latching Float Collar Valve Assembly 20. In fact, the top level of cement in the well is designated as element 40. Below 40, cement fills the annulus of the borehole 2. Above 40, mud fills the annulus of the borehole 2. For example, cement is present at position 42 and drilling mud is present at position 44 in FIG. 1.

Relatively thin-wall casing, or drill pipe, designated as element 46 in FIG. 1, is attached to the Latching Sub 18. The bottom male threads of the drill pipe 48 are screwed into the female threads 50 of the Latching Sub 18.

The drilling mud was wiped off the walls of the drill pipe 48 in the well with Bottom Wiper Plug 52. The Bottom Wiper Plug 52 is fabricated from rubber in the shape shown. Portions 54 and 56 of the Upper Seal of the Bottom Wiper Plug 52 are shown in a ruptured condition in FIG. 1. Initially, they sealed the upper portion of the Bottom Wiper Plug 52. Under pressure from cement, the Bottom Wiper Plug 52 is pumped down into the well until the Lower Lobe 58 of the Bottom Wiper Plug 52 latches into place into Latching Sub Recession 60 in the Latching Sub 18. After the Bottom Wiper Plug 52 latches into place, the pressure of the cement ruptures the Upper Seal of the Bottom Wiper Plug 52. A Bottom Wiper Plug Lobe 62 is shown in FIG. 1. Such lobes provide an efficient means to wipe the mud off the walls of the drill pipe 48 while the Bottom Wiper Plug 52 is pumped downhole with cement.

Top Wiper Plug 64 is being pumped downhole by water 66 under pressure in the drill pipe. As the Top Wiper Plug 64 is pumped down under water pressure, the cement remaining in region 68 is forced downward through the Bottom Wiper Plug 52, through the Latching Float Collar Valve Assembly 20, through the waterpassages of the drill bit and into the annulus in the well. A Top Wiper Plug Lobe 70 is shown in FIG. 1. Such lobes provide an efficient means to wipe the cement off the walls of the drill pipe while the Top Wiper Plug 64 is pumped downhole with water.

After the Bottom Surface 72 of the Top Wiper Plug 64 is forced into the Top Surface 74 of the Bottom Wiper Plug 52, almost the entire "cement charge" has been forced into the annulus between the drill pipe and the hole. As pressure is reduced on the water, the Float of the Latching Float Latching Float Collar Valve Assembly 20 seals against the Float Seating Surface. As the water pressure is reduced on the inside of the drill pipe, then the cement in the annulus between the drill pipe and the hole can cure under ambient hydrostatic conditions. This procedure herein provides an example of the proper operation of a "one-way cement valve means".

Therefore, the preferred embodiment in FIG. 1 provides apparatus that uses the steel drill string attached to a drilling bit during drilling operations used to drill oil and gas wells for a second purpose as the casing that is cemented in place during typical oil and gas well completions.

The preferred embodiment in FIG. 1 provides apparatus and methods of operation of said apparatus that results in the efficient installation of a cemented steel cased well during one single pass down into the earth of the steel drill string thereby making a steel cased borehole or cased well.

The steps described herein in relation to the preferred embodiment in FIG. 1 provides a method of operation that uses the typical mud passages already present in a typical rotary drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single pass into the earth.

The preferred embodiment of the invention further provides apparatus and methods of operation that result in the pumping of cement down the drill string, through the mud passages in the drill bit, and into the annulus between the formation and the drill string for the purpose of cementing the drill string and the drill bit into place during one single drilling pass into the formation.

The apparatus described in the preferred embodiment in FIG. 1 also provide a one-way cement valve and related devices installed near the drill bit of the drill string that allows the cement to set up efficiently while the drill string and drill bit are cemented into place during one single drilling pass into the formation.

Methods of operation of apparatus disclosed in FIG. 1 have been disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in detail below. The New Drilling Process is now possible because of "Several Recent Changes in the Industry" also described in detail below.

Typical procedures used in the oil and gas industries to drill and complete wells are well documented. For example, such procedures are documented in the entire "Rotary Drilling Series" published by the Petroleum Extension Service of the University of Texas at Austin, Austin, Tex. that is included herein by reference in its entirety comprised of the following: Unit I—"The Rig and Its Maintenance" (12 Lessons); Unit II—"Normal Drilling Operations" (5 Lessons); Unit III—Nonroutine Rig Operations (4 Lessons); Unit IV—Man Management and Rig Management (1 Lesson); and Unit V—Offshore Technology (9 Lessons). All of the individual Glossaries of all of the above Lessons are explicitly included in the specification herein and any and all definitions in those Glossaries shall be considered explicitly referenced herein.

Additional procedures used in the oil and gas industries to drill and complete wells are well documented in the series entitled "Lessons in Well Servicing and Workover" published by the Petroleum Extension Service of the University of Texas at Austin, Austin, Tex. that is included herein by reference in its entirety comprised of all 12 Lessons. All of the individual Glossaries of all of the above Lessons are explicitly included in the specification herein and any and all definitions in those Glossaries shall be considered explicitly referenced herein.

With reference to typical practices in the oil and gas industries, a typical drilling process may therefore be described in the following.

Typical Drilling Process

From an historical perspective, completing oil and gas wells using rotary drilling techniques has in recent times comprised the following typical steps:

Step 1

With a pile driver or rotary rig, install any necessary conductor pipe on the surface for attachment of the blowout preventer and for mechanical support at the wellhead.

Step 2

Install and cement into place any surface casing necessary to prevent washouts and cave-ins near the surface, and to prevent the contamination of freshwater sands as directed by state and federal regulations.

Step 3

Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Step 4

Drill the production well using a succession of rotary drill bits attached to the drill string until the hole is drilled to its final depth.

Step 5

After the final depth is reached, pull out the drill string and its attached drill bit.

Step 6

Perform open-hole logging of the geological formations to determine the amount of oil and gas present. This typically involves measurements of the porosity of the rock, the electrical resistivity of the water present, the electrical resistivity of the rock, certain neutron measurements from within the open-hole, and the use of Archie's Equations. If no oil and gas is present from the analysis of such open-hole logs, an option can be chosen to cement the well shut. If commercial amounts of oil and gas are present, continue the following steps.

Step 7

Typically reassemble drill bit and drill string into the well to clean the well after open-hole logging.

Step 8

Pull out the drill string and its attached drill bit.

Step 9

Attach the casing shoe into the bottom male pipe threads of the first length of casing to be installed into the well. This casing shoe may or may not have a one-way valve ("casing shoe valve") installed in its interior to prevent fluids from back-flowing from the well into the casing string.

Step 10

Typically install the float collar onto the top female threads of the first length of casing to be installed into the well which has a one-way valve ("float collar valve") that allows the mud and cement to pass only one way down into the hole thereby preventing any fluids from back-flowing from the well into the casing string. Therefore, a typical installation has a casing shoe attached to the bottom and the float collar valve attached to the top portion of the first length of casing to be lowered into the well. Please refer to pages 28–31 of the book entitled "Casing and Cementing" Unit II Lesson 4, Second Edition, of the Rotary Drilling Series, Petroleum Extension Service, The University of Texas at Austin, Tex., 1982 (hereinafter defined as "Ref. 1"). All of the individual definitions of words and phrases in the Glossary of Ref. 1 are explicitly included herein in their entirety.

Step 11

Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

Step 12

To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps:

A. Introduce the Bottom Wiper Plug into the interior of the steel casing assembled in the well and pump down with cement that cleans the mud off the walls and separates the mud and cement (Ref. 1, pages 28–31).

B. Introduce the Top Wiper Plug into the interior of the steel casing assembled into the well and pump down with water under pump pressure thereby forcing the cement through the float collar valve and any other one-way valves present (Ref. 1, pages 28–31).

C. After the Bottom Wiper Plug and the Top Wiper Plug have seated in the float collar, release the pump pressure on the water column in the casing that results in the closing of the float collar valve which in turn prevents cement from backing up into the interior of the casing. The resulting interior pressure release on the inside of the casing upon closure of the float collar valve prevents distortions of the casing that might prevent a good cement seal (Ref. 1, page 30). In such circumstances, "the cement is cured under ambient hydrostatic conditions".

Step 13

Allow the cement to cure.

Step 14

Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Tex., 1971 (hereinafter defined as "Ref. 2"). All of the individual definitions of words and phrases in the Glossary of Ref. 2 are explicitly included herein in their entirety. Other methods of completing the well are described therein that shall, for the purposes of this application herein, also be called "final completion operations".

Several Recent Changes in the Industry

Several recent concurrent changes in the industry have made it possible to reduce the number of steps defined above. These changes include the following:

a. Until recently, drill bits typically wore out during drilling operations before the desired depth was reached by the production well. However, certain drill bits have recently been able to drill a hole without having to be changed. For example, please refer to the book entitled "The Bit", Unit I, Lesson 2, Third Edition, of the Rotary Drilling Series, The University of Texas at Austin, Tex., 1981 (hereinafter defined as "Ref. 3"). All of the individual definitions of words and phrases in the Glossary of Ref. 3 are explicitly included herein in their entirety. On page 1 of Ref. 3 it states: "For example, often only one bit is needed to make a hole in which the casing will be set." On page 12 of Ref. 3 it states in relation to tungsten carbide insert roller cone bits: "Bit runs as long as 300 hours have been achieved; in some instances, only one or two bits have been needed to drill a well to total depth." This is particularly so since the advent of the sealed bearing tri-cone bit designs appeared in 1959 (Ref. 3, page 7) having tungsten carbide inserts (Ref. 3, page 12). Therefore, it is now practical to talk about drill bits lasting long enough for drilling a well during one pass into the formation, or "one pass drilling".

b. Until recently, it has been impossible or impractical to obtain sufficient geophysical information to determine the presence or absence of oil and gas from inside steel pipes in wells. Heretofore, either standard open-hole logging tools or Measurement-While-Drilling ("MWD") tools were used in the open-hole to obtain such information. Therefore, the industry has historically used various open-hole tools to measure formation characteristics. However, it has recently become possible to measure the various geophysical quantities listed in Step 6 above from inside steel pipes such as drill strings and casing strings. For example, please refer to the book entitled "Cased Hole Log Interpretation Principles/applications", Schlumberger Educational Services, Houston, Tex., 1989. Please also refer to the article entitled "Electrical Logging: State-of-the-Art", by Robert E. Maute, The Log Analyst, May-June 1992, pages 206–227.

Because drill bits typically wore out during drilling operations until recently, different types of metal pipes have historically evolved which are attached to drilling bits, which, when assembled, are called "drill strings". Those drill strings are different than typical "casing strings" run into the well. Because it was historically absolutely necessary to do open-hole logging to determine the presence or absence of oil and gas, the fact that different types of pipes were used in "drill strings" and "casing strings" was of little consequence to the economics of completing wells. However, it is possible to choose the "drill string" to be acceptable for a second use, namely as the "casing string" that is to be installed after drilling has been completed.

New Drilling Process

Therefore, the preferred embodiments of the invention herein reduce and simplify the above 14 steps as follows:

Repeat Steps 1–2 Above.

Steps 3–5 (Revised)

Choose the drill bit so that the entire production well can be drilled to its final depth using only one single drill bit. Choose the dimensions of the drill bit for desired size of the production well. If the cement is to be cured under ambient hydrostatic conditions, attach the drill bit to the bottom female threads of the Latching Subassembly ("Latching Sub"). Choose the material of the drill string from pipe material that can also be used as the casing string. Attach the first section of drill pipe to the top female threads of the Latching Sub. Rotary drill the production well to its final depth during "one pass drilling" into the well. While drilling, simultaneously circulate drilling mud to carry the rock chips to the surface, to prevent blowouts, to prevent excessive mud loss into formation, to cool the bit, and to clean the bit. Open-hole logging can be done while the well is being drilled with measuring-while-drilling (MWD) or logging-while-drilling (LWD) techniques. LWD is obtaining logging measurements by MWD techniques as the well is being drilled. MWD is the acquisition of downhole information during the drilling process. One MWD system transmits data to the surface via wireline; the other, through drilling fluid. MWD systems are capable of transmitting well data to the surface without interrupting circulating and drilling.

MWD may be used to determine the angle and direction by which the wellbore deviates from the vertical by directional surveying during routine drilling operations. A steering tool is a directional survey instrument used in combination with a deflected downhole motor that shows, on a rig floor monitor, the inclination and direction of a downhole sensing unit. A gyroscopic surveying instrument may be used to determine direction and angle at which a wellbore is drifting off the vertical. The steering tool instrument enables the operator both to survey and to orient a downhole motor while actually using a deflection tool to make hole. Sensors in the downhole instrument transmit data continuously, via the wireline, to the surface monitor. The operator can compensate for reactive torque, maintain hole direction, and change course when necessary without tripping out the drill string or interrupting drilling. MWD systems furnish the directional supervisor with real-time directional data on the rig floor—that is, they show what is happening downhole during drilling. The readings are analyzed to provide accurate hole trajectory.

Step 6 (Revised)

After the final depth of the production well is reached, perform logging of the geological formations to determine the amount of oil and gas present from inside the drill pipe of the drill string. This typically involves measurements from inside the drill string of the necessary geophysical quantities as summarized in Item "b." of "Several Recent Changes in the Industry". If such logs obtained from inside the drill string show that no oil or gas is present, then the drill string can be pulled out of the well and the well filled in with cement. If commercial amounts of oil and gas are present, continue the following steps.

Steps 7–11 (Revised)

If the cement is to be cured under ambient hydrostatic conditions, pump down a Latching Float Collar Valve Assembly with mud until it latches into place in the notches provided in the Latching Sub located above the drill bit.

Steps 12–13 (Revised)

To "cure the cement under ambient hydrostatic conditions", typically execute a two-plug cementing procedure involving a first Bottom Wiper Plug before and a second Top Wiper Plug behind the cement that also minimizes cement contamination comprised of the following individual steps:

A. Introduce the Bottom Wiper Plug into the interior of the drill string assembled in the well and pump down with cement that cleans the mud off the walls and separates the mud and cement.

B. Introduce the Top Wiper Plug into the interior of the drill string assembled into the well and pump down with water thereby forcing the cement through any Float Collar Valve Assembly present and through the watercourses in "a regular bit" or through the mud nozzles of a "jet bit" or through any other mud passages in, the drill bit into the annulus between the drill string and the formation.

C. After the Bottom Wiper Plug and Top Wiper Plug have seated in the Latching Float Collar Valve Assembly, release the pressure on the interior of the drill string that results in the closing of the float collar which in turn prevents cement from backing up in the drill string. The resulting pressure release upon closure of the float collar prevents distortions of the drill string that might prevent a good cement seal as described earlier. I.e., "the cement is cured under ambient hydrostatic conditions".

Repeat Step 14 Above.

Centering the casing in the hole is necessary for cement to form a uniform sheath around the casing to effectively prevent migration of fluids from permeable zones. Various accessory devices assure better distribution of the cement slurry outside the casing.

Field reports show that that casing cementation is improved by the employment of centralizers. Centralizers are often used on casing for two main purposes in connection with cementing: (1) to ensure a reasonably uniform distribution of cement around the pipe, and (2) to obtain a compete seal between the casing and the formation. Centralizers allow proper cement distribution by holding casing away from the wall. Centralizers also lessen the effect of differential pressure to stick the liner and center the pipe in the hole. A casing centralizer is a device secured around the casing at regular intervals to center it in the hole. Hinged centralizers are usually clamped onto the casing after it is made up and as it is run into the hole.

Therefore, the "New Drilling Process" has only 7 distinct steps instead of the 14 steps in the "Typical Drilling Process". The "New Drilling Process", consequently has fewer steps, is easier to implement, and will be less expensive.

The preferred embodiment of the invention disclosed in FIG. 1 requires a Latching Subassembly and a Latching Float Collar Valve Assembly. The advantage of this approach is that the Float 32 of the Latching Float Collar Valve Assembly and the Float Seating Surface 34 in FIG. 1 are installed at the end of the drilling process and will not be worn due to mud passage during normal drilling operations.

Another preferred embodiment of the invention provides a float and float collar valve assembly permanently installed within the Latching Subassembly at the beginning of the drilling operations. However, such a preferred embodiment has the disadvantage that drilling mud passing by the float and the float collar valve assembly during normal drilling operations will tend to wear on the mutually sealing surfaces.

The drill bit described in FIG. 1 is a milled steel toothed roller cone bit. However, any rotary bit can be used with the invention. A tungsten carbide insert roller cone bit can be used. Any type of diamond bit or drag bit can be used. The invention may be used with any drill bit described in Ref. 3 above that possesses mud passages, waterpassages, or passages for gas. The bit consists of a cutting element and circulating element. The cutting element penetrates and gouges or scrapes the formation to remove it. The circulating element permits passage of drilling fluid and utilizes the hydraulic force of the fluid stream to improve drilling rates. Any type of rotary drill bit can be used possessing such passageways. Similarly, any type of bit whatsoever that utilizes any fluid or gas that passes through passageways in the bit can be used whether or not the bit rotates. A drag bit, for example, is any of a variety of drilling bits with no moving parts that drill by intrusion and drag.

A rock bit cone or other chunk of metal is sometimes left in an open hole and never touched again. A fish is an object that is left in the wellbore during drilling or workover operations and that must be recovered before work can proceed, which may be anything from a piece of scrap metal to a part of the drill stem. The drill stem includes all members in the assembly used for rotary drilling from the swivel to the bit. The fish may be part of the drill string which has been purposely disconnected, so that the part of the drill string may be recovered from the well by fishing.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. An apparatus for drilling a wellbore comprising:

a drill string having a casing portion for lining the wellbore;

a drilling assembly operatively connected to the drill string and having an earth removal member, a portion of the drilling assembly being selectively removable from the wellbore without removing the casing portion; and a one-way cement valve disposed within the casing portion.

2. The apparatus of claim 1, wherein the earth removal member is connected to a lower end of the casing portion.

3. The apparatus of claim 1, wherein the earth removal member is a boring element.

4. The apparatus of claim 1, wherein the earth removal member is operatively connected to the casing portion.

5. The apparatus of claim 1, wherein the portion of the drilling assembly being selectively removable from the wellbore is the earth removal member.

6. The apparatus of claim 1, wherein the earth removal member is a drill bit.

7. The apparatus of claim 1, wherein the earth removal member is operatively connected to the drill string while the one-way cement valve is disposed within the casing portion.

8. The apparatus of claim 1, wherein the entire earth removal member which is used to drill the wellbore is removable from the wellbore without removing the casing portion.

9. The apparatus of claim 1, wherein an extended outer diameter of the earth removal member is at least as large as an outer diameter of the casing portion.

10. The apparatus of claim 1, wherein the earth removal member is attached to a section of the casing portion having a maximum sustained outer diameter that is no larger than a maximum outer diameter of the entire casing portion.

11. A method for lining a wellbore with a tubular comprising:

drilling the wellbore using a drill string, the drill string having a casing portion;

locating the casing portion within the wellbore;

placing a physically alterable bonding material in an annulus formed between the casing portion and the wellbore;

establishing a hydrostatic pressure condition in the wellbore by substantially displacing the physically alterable bonding material from an interior of the tubular; and allowing the bonding material to physically alter under the hydrostatic pressure condition.

12. The method of claim 11, wherein placing the physically alterable bonding material in the annulus comprises flowing the material through an earth removal member connected to the drill string.

13. The method of claim 12, further comprising circulating drilling fluid through the earth removal member while locating the casing portion within the wellbore.

14. The method of claim 11, wherein the bonding material is allowed to physically alter by reducing fluid pressure within the drill string.

15. The method of claim 11, further comprising stabilizing the drill string while drilling the wellbore.

16. The method of claim 11, further comprising maintaining the casing portion in a substantially centralized position in relation to a diameter of the wellbore after locating the casing portion within the wellbore.

17. The method of claim 11, wherein the physically alterable bonding material is cement.

18. The method of claim 11, wherein drilling the wellbore using the drill string comprises drilling with an earth removal member operatively connected to the drill string.

19. The method of claim 18, wherein the earth removal member is connected to the casing portion.

20. The method of claim 19, wherein the earth removal member is connected to a lower end of the casing portion.

21. The method of claim 11, wherein the hydrostatic pressure condition is maintained by use of a one-way valve member.

22. The method of claim 11, wherein drilling the wellbore using the drill string is accomplished by an earth removal member, the earth removal member being operatively connected to the drill string and capable of drilling the entire, complete swept bore for the casing portion.

23. An apparatus for drilling a wellbore comprising:

a drill string having a casing portion for lining the wellbore; and a drilling assembly operatively connected to the drill string and having an earth removal member and a geophysical parameter sensing member.

24. The apparatus of claim 23, wherein a porosity of an earth formation is measured by the geophysical parameter sensing member.

25. The apparatus of claim 23, wherein electrical resistivity is measured by the geophysical parameter sensing member.

26. The apparatus of claim 23, wherein the geophysical parameter sensing member is disposed within the drill string.

27. The apparatus of claim 23, wherein the earth removal member is connected to a lower end of the drill string.

28. The apparatus of claim 23, wherein the geophysical parameter sensing member comprises a measuring-while-drilling tool.

29. The apparatus of claim 23, wherein the geophysical parameter sensing member comprises a logging-while-drilling tool.

30. A method for drilling and lining a wellbore comprising:

drilling the wellbore using a drill string, the drill string having an earth removal member operatively connected thereto and a casing portion for lining the wellbore;

selectively causing a drilling trajectory to change during the drilling; and lining the wellbore with the casing portion.

31. The method of claim 30, wherein drilling the wellbore using a drill string comprises lowering the drill string into an earth formation.

32. The method of claim 31, wherein drilling the wellbore using a drill string further comprises rotating the earth removal member while lowering.

33. The method of claim 30, further comprising stabilizing the drill string while drilling the wellbore using the drill string to maintain drilling trajectory.

34. The method of claim 30, wherein the earth removal member is connected to a tower end of the drill string.

35. A method for drilling and lining a wellbore comprising:

drilling the wellbore using a drill string, the drill string having an earth removal member operatively connected thereto and a casing portion for lining the wellbore;

stabilizing the drill string while drilling the wellbore;

locating the casing portion within the wellbore;

maintaining the casing portion in a substantially centralized position in relation to a diameter of the wellbore;

placing a physically alterable bonding material in an annulus between the diameter of the wellbore and the casing portion; and allowing the physically alterable bonding material to physically alter under an established hydrostatic pressure condition, the hydrostatic pressure condition established by substantially displacing the physically alterable bonding material from an interior of the casing portion.

36. The method of claim 35, wherein stabilizing the drill string while drilling creates an annulus between the casing portion and the diameter of the wellbore which is substantially uniform in width circumferentially.

37. The method of claim 35, wherein stabilizing the drill string comprises stabilizing the casing portion while drilling the wellbore.

38. An apparatus for drilling a wellbore comprising:

a drill string having a casing portion for lining the wellbore;

a drilling assembly selectively connected to the drill string and having an earth removal member; and a one-way cement valve located within the casing portion.

39. The apparatus of claim 38, wherein the earth removal member is connected to a lower end of the drill string.

40. The apparatus of claim 38, wherein the earth removal member is a boring element.

41. An apparatus for drilling a wellbore comprising:

a drill having a casing portion for lining the wellbore; and a drilling assembly operatively connected to the drill string and having an earth removal member, a portion of the drilling assembly being selectively removable from the wellbore without removing the casing portion, wherein the one-way cement valve is disposed near the earth removal member.

42. A method for drilling and lining a wellbore comprising:

drilling the wellbore using a drill string, the drill string having an earth removal member operatively connected thereto and a casing portion for lining the wellbore;

selectively causing a drilling trajectory to change during the drilling;

lining the wellbore with the casing portion; and sensing a geophysical parameter while drilling the wellbore using the drill string.

43. The method of claim 42, wherein the geophysical parameter is the drilling trajectory.

44. A method for drilling and lining a wellbore comprising:

drilling the wellbore using a drill string, the drill string having an earth removal member operatively connected thereto and a casing portion for lining the wellbore;

selectively causing a drilling trajectory to change during the drilling; and lining the wellbore with the casing portion, wherein the earth removal member is a jet deflection bit.

45. A method for drilling and lining a wellbore comprising:

drilling the wellbore using a drill string, the drill string having an earth removal member operatively connected thereto and a casing portion for lining the wellbore;

selectively causing a drilling trajectory to change during the drilling; and lining the wellbore with the casing portion, wherein selectively causing the drilling trajectory to change is accomplished by measuring while drilling.

46. A method for drilling and lining a wellbore comprising:

drilling the wellbore using a drill string, the drill string having an earth removal member operatively connected thereto and a casing portion for lining the wellbore;

selectively causing a drilling trajectory to change during the drilling; and lining the wellbore with the casing portion, wherein selectively causing the drilling trajectory to change is accomplished by logging while drilling.

47. An apparatus for drilling a wellbore comprising:

a drill string having a casing portion for lining the wellbore;

a drilling assembly selectively connected to the drill string and having an earth removal member; and a one-way cement valve located within the casing portion, wherein the one-way cement valve is disposed near the earth removal member.

* * * * *

UNITED STATES PATENT AND TRADEMARK OFFICE

CERTIFICATE OF CORRECTION

PATENT NO. : 7,048,050 B2
APPLICATION NO. : 10/678731
DATED : May 23, 2006
INVENTOR(S) : William Banning Vail, III It is certified that error appears in the above-identified patent and that said Letters Patent is hereby corrected as shown below:

On the Title page of the patent, (75) Inventors, please delete "James F. Chitwood, Houston, TX (US)".

Signed and Sealed this

Thirty-first Day of October, 2006

JON W. DUDAS
*Director of the United States Patent and Trademark Office*

US007048050C1

(12) INTER PARTES REEXAMINATION CERTIFICATE (0323rd)

United States Patent

Vail, III

(10) Number: US 7,048,050 C1

(45) Certificate Issued: Nov. 29, 2011

(54) METHOD AND APPARATUS FOR CEMENTING DRILL STRINGS IN PLACE FOR ONE PASS DRILLING AND COMPLETION OF OIL AND GAS WELLS

(75) Inventor: William Banning Vail, III, Bothell, WA (US)

(73) Assignee: Weatherford/Lamb, Inc., Houston, TX (US)

Reexamination Request:
No. 95/001,113, Nov. 18, 2008

Reexamination Certificate for:

| | |
|---|---|
| Patent No.: | **7,048,050** |
| Issued: | **May 23, 2006** |
| Appl. No.: | **10/678,731** |
| Filed: | **Oct. 2, 2003** |

Certificate of Correction issued Oct. 31, 2006.

Related U.S. Application Data

(63) Continuation of application No. 10/162,302, filed on Jun. 4, 2002, now Pat. No. 6,868,906, which is a continuation-in-part of application No. 09/487,197, filed on Jan. 19, 2000, now Pat. No. 6,397,946, which is a continuation-in-part of application No. 09/295,808, filed on Apr. 20, 1999, now Pat. No. 6,263,987, which is a continuation-in-part of application No. 08/708,396, filed on Sep. 3, 1996, now Pat. No. 5,894,897, which is a continuation-in-part of application No. 08/323,152, filed on Oct. 14, 1994, now Pat. No. 5,551,521.

(60) Provisional application No. 60/313,654, filed on Aug. 19, 2001, provisional application No. 60/353,457, filed on Jan. 31, 2002, provisional application No. 60/367,638, filed on Mar. 26, 2002, and provisional application No. 60/384,964, filed on Jun. 3, 2002.

(51) Int. Cl.
*E21B 44/06* (2006.01)
*E21B 43/00* (2006.01)

(52) U.S. Cl. ..... 166/250.01; 166/250.15; 166/65.1; 166/66.7; 340/853.3

(58) Field of Classification Search ..... 166/250.61, 166/250.15, 65.1, 66.7, 386, 54; 340/853.3; 175/318, 309
See application file for complete search history.

(56) References Cited

To view the complete listing of prior art documents cited during the proceeding for Reexamination Control Number 95/001,113, please refer to the USPTO's public Patent Application Information Retrieval (PAIR) system under the Display References tab.

*Primary Examiner*—Matthew C. Graham

(57) ABSTRACT

The steel drill string attached to a drilling bit during typical rotary drilling operations used to drill oil and gas wells is used for a second purpose as the casing that is cemented in place during typical oil and gas well completions. Methods of operation are described that provide for the efficient installation a cemented steel cased well wherein the drill string and the drill bit are cemented into place during one single drilling pass down into the earth. The normal mud passages or watercourses present in the rotary drill bit are used for the second independent purpose of passing cement into the annulus between the casing and the well while cementing the drill string into place during one single pass into the earth. A one-way cement valve is installed near the drill bit of the drill string that allows the cement to set up efficiently under ambiently hydrostatic conditions while the drill string and drill bit are cemented into place during one single drilling pass into the earth.

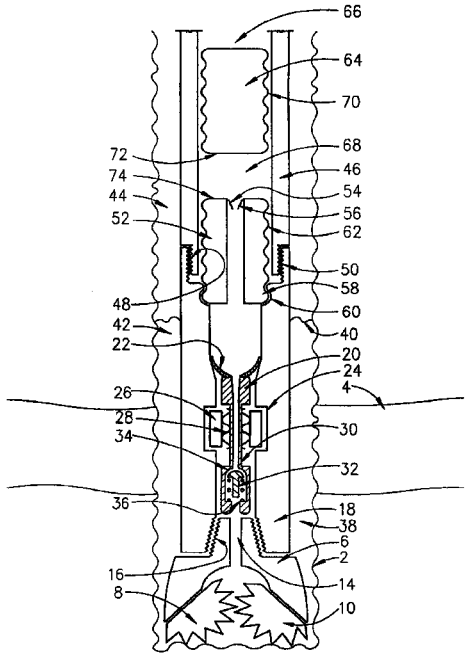

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-10, 14, 31, 32, 34, 38-41 and 47 are cancelled.

Claims 11, 21, 23, 30, 35, 42, 44, 45 and 46, are determined to be patentable as amended.

Claims 12-13, 15-20, 22, 24-29, 33, 36, 37 and 43, dependent on an amended claim, are determined to be patentable.

New claims 48-51 are added and determined to be patentable.

11. A method for *drilling and* lining a wellbore with a tubular comprising:

drilling the wellbore using a drill string, the drill string having a casing portion *comprising an interior passageway*;

locating the casing portion within the wellbore;

*lowering a one-way valve through the interior passageway of the casing portion after the casing portion is located within the wellbore;*

*installing the one-way valve in the interior passageway of the casing portion;*

*after the step of installing the one-way valve, introducing a physically alterable bonding material into the interior passageway of the casing portion;* placing [a] *the* physically alterable bonding material in an annulus formed between the casing portion and the wellbore;

establishing [a] *an ambient* hydrostatic pressure condition in the wellbore by *performing the following steps: applying pressure to the physically alterable bonding material for* substantially displacing the physically alterable bonding material from [an interior of the tubular] *the interior passageway through the one-way valve and into the annulus and thereafter reducing pressure from the interior passageway and allowing the one-way valve to close*; and allowing the bonding material to physically alter under the *ambient* hydrostatic pressure condition.

21. The method of claim 11, wherein the hydrostatic pressure condition is maintained by use of [a] *the* one-way valve member.

23. An apparatus for drilling *and lining* a wellbore comprising:

a drill string having a casing portion for lining the wellbore*, the casing portion having an interior passageway with an annular recess*;

a drilling assembly operatively connected to the drill string and having an earth removal member and a geophysical parameter sensing member;

*a one-way valve adapted to be installed in the interior passageway after the casing portion is in the wellbore, the one-way valve comprising a latch for engagement with the annular recess; and*

*first and second wiper plugs separate from the one-way valve adapted to be lowered through the interior passageway of the casing portion after the one-way valve is installed, with a charge of physically alterable bonding material therebetween.*

30. [A method for drillings and lining a wellbore comprising:

drilling the wellbore using a drill string, the drill string having an earth removal member operatively connected thereto and a casing portion for lining the wellbore;] *The method of claim 11, and further comprising* selectively causing a drilling trajectory to change during the drilling [;]and lining the casing with the casing portion].

35. [A method for drilling and lining a wellbore comprising: drilling the wellbore using a drill string, the drill string having an earth removal member operatively connected thereto and a casing portion for lining the wellbore;] *The method of claim 11, and further comprising:* stablizing the drill string while drilling the wellbore; *and*

[locating the casing portion within the wellbore;]

maintaing the casing portion in a substantially centralized position in relation to a diameter of the wellbore[;

placing a physically alterable bonding material in an annulus between the diameter of the wellbore and the casing portion; and allowing the physically alterable bonding material to physically alter under an established hydrostatic pressure condition, the hydrostatic pressure condition established by substantially displacing the physically alterable bonding material from an interior of the casing portion].

42. [A method for drilling and lining a wellbore comprising: drilling the wellbore using a drill string, the drill string having an earth removal member operatively connected thereto and a casing portion for lining the wellbore;] *The method of claim 11, and further comprising:* selectively causing a drilling trajectory to change during the drilling; [lining the wellbore with the casing portion;] and sensing a geophysical parameter while drilling the wellbore using the drill string.

44. [A method for drilling and lining a wellbore comprising: drilling the wellbore using a drill string, the drill string having an earth removal member operatively connected thereto and a casing portion for lining the wellbore; selectively causing a drilling trajectory to change during the drilling; and lining the wellbore with the casing portion] *The method of claim 12*, wherein the earth removal member is a jet deflection bit.

45. [A method for drilling and lining a wellbore comprising: drilling the wellbore using a drill string, the drill string having an earth removal member operatively connected thereto and a casing portion for lining the wellbore; selectively causing a drilling trajectory to change during the drilling; and lining the wellbore with the casing portion] *The method of claim 30*, wherein selectively causing the drilling trajectory to change is accomplished by measuring while drilling.

46. [A method for drilling and lining a wellbore comprising: drilling the wellbore using a drill string, the drill string having an earth removal member operatively connected thereto and a casing portion for lining the wellbore; selectively causing a drilling trajectory to change during the drilling; and lining the wellbore with the casing portion, wherein] *The method of claim 30, wherein* selectively causing the drilling trajectory to change is accomplished by logging while drilling.

*48. The method of claim 11, wherein the step of placing the physically alterable bonding material includes lowering first and second wiper plugs through the interior passageway of the casing portion with a physically alterable bonding material therebetween for placing the physically alterable bonding material into the annulus formed between the casing portion and the wellbore.*

*49. The method of claim 11, wherein the step of lowering a one-way valve includes lowering a latching float collar valve assembly through the interior passageway.*

*50. The method of claim 49, wherein the step of installing a one-way valve includes having a spring pushing a latch on the latching float collar valve assembly into a recess formed in the interior passageway.*

*51. The method of claim 11, wherein the one-way valve is installed into engagement with a recess formed in the interior passageway.*

* * * * *